US010220863B2

(12) United States Patent
Green et al.

(10) Patent No.: US 10,220,863 B2
(45) Date of Patent: Mar. 5, 2019

(54) GUIDEWAY MOUNTED VEHICLE LOCALIZATION SYSTEM

(71) Applicant: Thales Canada Inc, Toronto, Ontario (CA)

(72) Inventors: Alon Green, Toronto (CA); Walter Kinio, Toronto (CA); Rodney Ignatius, Toronto (CA); Firth Whitwam, Toronto (CA)

(73) Assignee: THALES CANADA INC., Toronto, Ontario (CA)

( * ) Notice: Subject to any disclaimer, the term of this patent is extended or adjusted under 35 U.S.C. 154(b) by 0 days.

(21) Appl. No.: 15/960,067

(22) Filed: Apr. 23, 2018

(65) Prior Publication Data

US 2018/0237043 A1 Aug. 23, 2018

Related U.S. Application Data

(63) Continuation of application No. 15/247,142, filed on Aug. 25, 2016, now Pat. No. 9,950,721.

(Continued)

(51) Int. Cl.

| | |
|---|---|
| ***B61L 25/02*** | (2006.01) |
| ***B61L 27/00*** | (2006.01) |
| ***B61L 25/00*** | (2006.01) |

(52) U.S. Cl.

CPC ..... *B61L 25/025* (2013.01); *B61L 25/021* (2013.01); *B61L 25/026* (2013.01); *B61L 27/0038* (2013.01); *B61L 2027/005* (2013.01)

(58) Field of Classification Search

CPC .... B61L 25/026; B61L 25/023; B61L 25/028; B61L 25/021; B61L 25/00; B61L 25/02;

(Continued)

(56) References Cited

U.S. PATENT DOCUMENTS 2,934,474 A 4/1960 Lavin et al.
4,353,068 A * 10/1982 Fernandez ..... B61L 13/02 246/182 C (Continued)

FOREIGN PATENT DOCUMENTS

| | | |
|---|---|---|
| CA | 2089220 | 8/1993 |
| CA | 2166344 | 7/1996 |

(Continued)

OTHER PUBLICATIONS

R. Schubert, P., et al., "Microwave Doppler Sensors Measuring Vehicle Speed and Travelled Distance: Realistic System Tests in Railroad Environment," 1995, <http://www.stereoscopicscanning.de/MIOP/MIOP95.pdf>.

(Continued)

*Primary Examiner* — Jason C Smith
(74) *Attorney, Agent, or Firm* — Hauptman Ham, LLP

(57) ABSTRACT

A system comprises a set of sensors on a first end of a vehicle having the first end and a second end, and a controller. The sensors are configured to generate corresponding sensor data based on a detected marker along a direction of movement of the vehicle. A first sensor has a first inclination angle with respect to the detected marker, and a second sensor has a second inclination angle with respect to the detected marker. The controller is configured to compare a time at which the first sensor detected the marker with a time at which the second sensor detected the marker to identify the first end or the second end as a leading end of the vehicle, and to calculate a position of the leading end of the vehicle based on the sensor data generated by one or more of the first sensor or the second sensor.

22 Claims, 9 Drawing Sheets

Related U.S. Application Data

(60) Provisional application No. 62/210,218, filed on Aug. 26, 2015.

(58) Field of Classification Search
CPC .... B61L 25/025; B61L 25/041; B61L 25/043; B61L 25/06; B61L 25/065
See application file for complete search history.

(56) References Cited

U.S. PATENT DOCUMENTS 4,414,548 A * 11/1983 Carpenter ..... G01S 13/60 340/441
4,489,321 A * 12/1984 Hoffa ..... G01S 13/60 342/115
4,920,345 A * 4/1990 Lissel ..... G01C 22/02 342/117
5,229,941 A 7/1993 Hattori
5,437,422 A * 8/1995 Newman ..... B61L 27/0038 246/182 R
5,530,651 A * 6/1996 Uemura ..... B60T 7/22 180/169
6,011,508 A * 1/2000 Perreault ..... B61L 3/225 246/122 R
6,163,755 A * 12/2000 Peer ..... B61L 21/041 340/436
6,679,702 B1 * 1/2004 Rau ..... G09B 9/02 340/435
6,911,642 B2 * 6/2005 Sartori ..... G06T 7/20 250/208.2
7,948,613 B2 * 5/2011 Fourcault ..... B60T 8/172 356/28
8,140,214 B2 * 3/2012 Krokel ..... G01P 3/68 348/142
8,812,227 B2 8/2014 Carlson et al.
9,327,743 B2 5/2016 Ignatius et al.
9,387,867 B2 7/2016 Ignatius et al.
2003/0222981 A1 * 12/2003 Kisak ..... B61L 15/0027 348/148
2004/0221790 A1 11/2004 Sinclair et al.
2008/0115372 A1 * 5/2008 Vogel ..... B01J 20/103 33/1 Q
2013/0060520 A1 * 3/2013 Amor ..... G01C 15/008 702/154
2013/0124061 A1 * 5/2013 Khanafer ..... G06F 17/00 701/70
2013/0261837 A1 * 10/2013 Sharma ..... G08G 1/167 701/1
2013/0325258 A1 * 12/2013 Cooper ..... B60T 7/18 701/36
2015/0134155 A1 * 5/2015 Kanner ..... G01B 7/125 701/19
2015/0175178 A1 * 6/2015 Ignatius ..... B61L 23/041 246/120
2015/0239482 A1 * 8/2015 Green ..... B61L 15/0063 246/122 R
2017/0057528 A1 * 3/2017 Green ..... B61L 25/025

FOREIGN PATENT DOCUMENTS

| | | | |
|---|---|---|---|
| CA | 2874312 | | 12/2013 |
| CA | 2934474 | | 6/2015 |
| CA | 2934474 | A1 | 6/2015 |
| CN | 101472778 | A | 7/2009 |
| CN | 102004246 | | 8/2012 |
| CN | 103018472 | | 4/2013 |
| CN | 103129586 | A | 6/2013 |
| CN | 104302531 | A | 1/2015 |
| WO | 1996034252 | | 10/1996 |
| WO | 2004103792 | | 12/2004 |

OTHER PUBLICATIONS

Neeraj K. Kanhere, et al., "Automatic Camera Calibration Using Pattern Detection for Vision-Based Speed Sensing," Aug. 1, 2007, <http://sites.poli.usp.br/ptr/lemt/documents/08-3030.pdf>.
Paul J. Besl, "Active, Optical Range Imaging Sensor," 1988, <https://classes.soe.ucsc.edu/cmps290b/Fall05/readings/Besl_MVA88_ActiveOpticalRangeSensors.pdf>.
Fengshan Dou, et al., "A New Speed Measurement Sensor Using Difference Structure," Aug. 2014, <http://www.nt.ntnu.no/users/skoge/prost/proceedings/ifac2014/media/files/0959.pdf>, all pages.
International Search Report for corresponding International PCT Application No. PCT/IB2016/055084, dated Nov. 8, 2016, all pages.
First Office Action from corresponding Chinese Patent Application No. 2016800623090, dated Nov. 26, 2018, pp. 1-5, State Intellectual Property Office of the P.R.C.

* cited by examiner

GUIDEWAY MOUNTED VEHICLE LOCALIZATION SYSTEM

PRIORITY CLAIM

The present application claims the priority benefit of U.S. application Ser. No. 15/247,142, filed Aug. 25, 2016, which claims the priority benefit of U.S. Provisional Patent Application No. 62/210,218, filed Aug. 26, 2015, the entirety of which is hereby incorporated by reference.

BACKGROUND

Guideway mounted vehicles include communication train based control (CTBC) systems to receive movement instructions from wayside mounted devices adjacent to a guideway. The CTBC systems are used to determine a location and a speed of the guideway mounted vehicle. The CTBC systems determine the location and speed by interrogating transponders positioned along the guideway. The CTBC systems report the determined location and speed to a centralized control system or to a de-centralized control system through the wayside mounted devices.

The centralized or de-centralized control system stores the location and speed information for guideway mounted vehicles within a control zone. Based on this stored location and speed information, the centralized or de-centralized control system generates movement instructions for the guideway mounted vehicles.

When communication between the guideway mounted vehicle and the centralized or de-centralized control system is interrupted, the guideway mounted vehicle is braked to a stop to await a manual driver to control the guideway mounted vehicle. Communication interruption occurs not only when a communication system ceases to function, but also when the communication system transmits incorrect information or when the CTBC rejects an instruction due to incorrect sequencing or corruption of the instruction.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
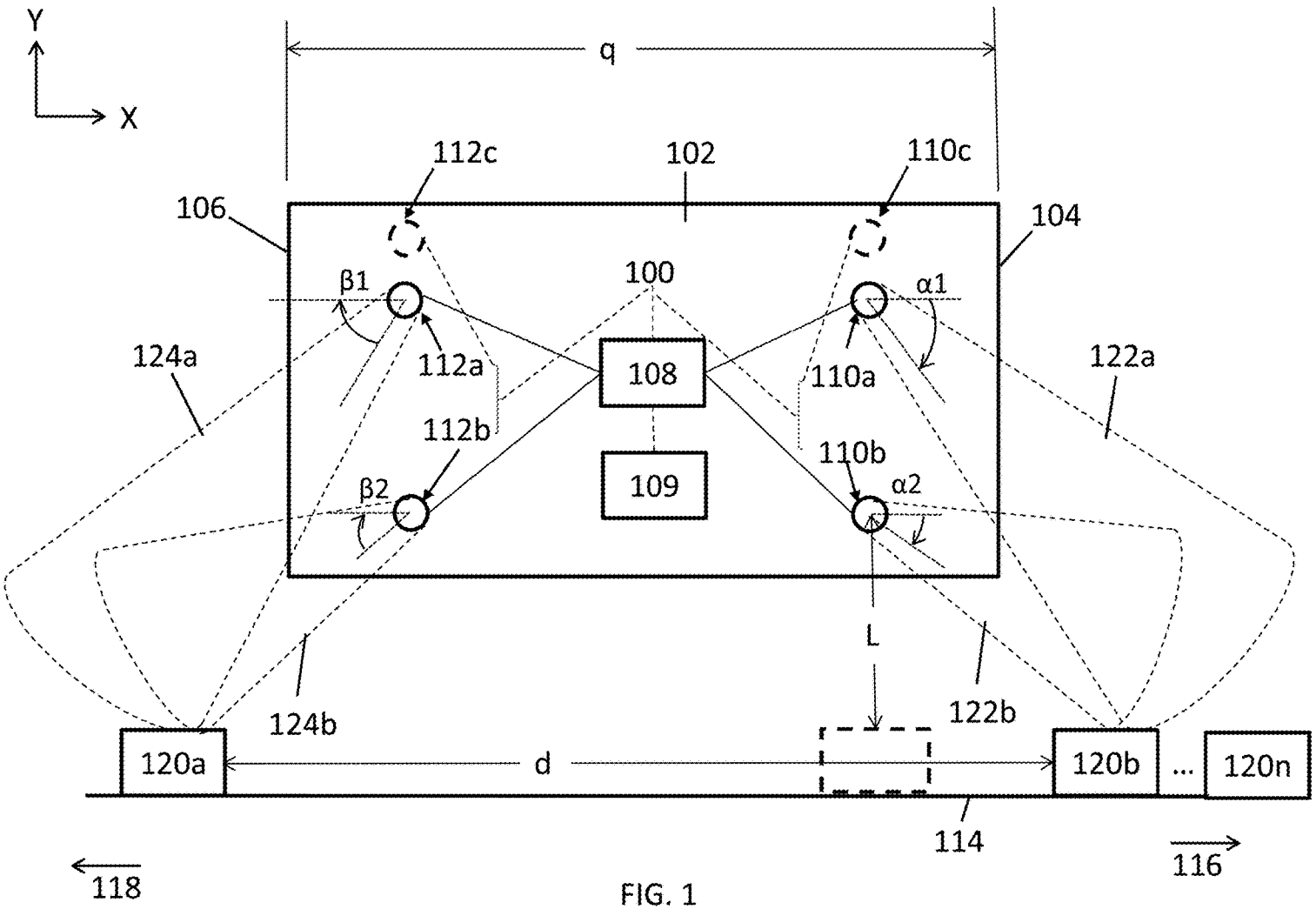
FIG. 1 is a diagram of a vehicle localization system, in accordance with one or more embodiments.

FIG. 1 is a diagram of a vehicle localization system 100, in accordance with one or more embodiments. Vehicle localization system 100 is associated with a vehicle 102 having a first end 104 and a second end 106. Vehicle localization system 100 comprises a controller 108, a memory 109, a first set of sensors including a first sensor 110*a*, a second sensor 110*b* (collectively referred to herein as the "first set of sensors 110") on the first end 104 of the vehicle 102, and a second set of sensors including a third sensor 112*a* and a fourth sensor 112*b* (collectively referred to herein as the "second set of sensors 112") on the second end 106 of the vehicle. In some embodiments, the first set of sensors 110 optionally includes a first auxiliary sensor 110*c*. In some embodiments, the second set of sensors 112 optionally includes a second auxiliary sensor 112*c*. In some embodiments, though described as a set of sensors, one or more of the first set of sensors 110 or the second set of sensors 112 includes only one sensor.

The controller 108 is communicatively coupled with the memory 109, the sensors of the first set of sensors 110 and with the sensors of the second set of sensors 112. The controller 108 is on-board the vehicle 102. If on-board, the controller 108 is a vehicle on-board controller ("VOBC"). In some embodiments, one or more of the controller 108 or the memory 109 is off-board the vehicle 102. In some embodiments, the controller 108 comprises one or more of the memory 109 and a processor (e.g., processor 902 (shown in FIG. 9)).

Vehicle 102 is configured to move along a guideway 114 in one of a first direction 116 or a second direction 118. In some embodiments, guideway 114 includes two spaced rails. In some embodiments, guideway 114 includes a monorail. In some embodiments, guideway 114 is along a ground. In some embodiments, guideway 114 is elevated above the ground. Based on which direction the vehicle 102 moves along the guideway 114, one of the first end 104 is a leading end of the vehicle 102 or the second end 106 is the leading end of the vehicle 102. The leading end of the vehicle 102 is the end of the vehicle 102 that corresponds to the direction of movement of the vehicle 102 along the guideway 114. For example, if the vehicle 102 moves in the first direction 116, then the first end 104 is the leading end of the vehicle 102. If the vehicle 102 moves in the second direction 118, then the second end 106 is the leading end of the vehicle 102. In some embodiments, the vehicle 102 is capable of being rotated with respect to the guideway 114 such that the first end 104 is the leading end of the vehicle 102 if the vehicle

102 moves in the second direction 118, and the second end 106 is the leading end of the vehicle 102 if the vehicle 102 moves in the first direction 116.

As the vehicle 102 moves in the first direction 116 or in the second direction 118 along the guideway 114, the sensors of the first set of sensors 110 and the sensors of the second set of sensors 112 are each configured to detect markers of a plurality of markers 120*a*-120*n*, where n is a positive integer greater than 1,. The markers of the plurality of markers 120*a*-120*n* are collectively referred to herein as "marker(s) 120." The sensors of the first set of sensors 110 and the sensor of the second set of sensors 112 are each configured to generate corresponding sensor data based on a detected marker 120.

A marker 120 is, for example, a static object such as a sign, a shape, a pattern of objects, a distinct or sharp change in one or more guideway properties (e.g. direction, curvature, or other identifiable property) which can be accurately associated with a specific location, or some other suitable detectable feature or object usable to determine a geographic location of a vehicle. One or more of the markers 120 are on the guideway 114. In some embodiments, one or more of the markers 120 are on a wayside of the guideway 114. In some embodiments, all of the markers 120 are on the guideway. In some embodiments, all of the markers 120 are on the wayside of the guideway. In some embodiments, the markers 120 comprise one or more of rails installed on the guideway 114, sleepers or ties installed on the guideway 114, rail baseplates installed on the guideway 114, garbage catchers installed on the guideway 114, boxes containing signaling equipment installed on the guideway 114, fence posts installed on the wayside of the guideway 114, signs installed on the wayside of the guideway 114, other suitable objects associated with being on the guideway 114 or on the wayside of the guideway 114. In some embodiments, at least some of the markers 120 comprise one or more different objects or patterns of objects compared to other markers 120. For example, if one marker 120 comprises a garbage catcher, a different marker 120 comprises a railroad tie.

Consecutive markers 120 are spaced apart by a distance d. In some embodiments, the distance d between consecutive markers 120 is substantially equal between all of the markers 120 of the plurality of markers 120*a*-120*n*. In some embodiments, the distance d between consecutive markers 120 is different between a first pair of markers 120 and a second pair of markers 120.

The memory 109 comprises data that includes information describing the markers 120 and a geographic position of the markers 120. Based on the detection of a marker 120, controller 108 is configured to query the memory 109 for the information describing the detected marker 120 such that the detected marker 120 has a location that is known to the controller 108.

Each of the sensors of the first set of sensors 110 and the sensors of the second set of sensors 112 is positioned on the first end 104 of the vehicle 102 or the second end of the vehicle 102 at a corresponding distance L from the markers 120. The distance L is measured in a direction perpendicular to the direction of movement of the vehicle 102, between each sensor of the first set of sensors 110 and each sensor of the second set of sensors 112 as the vehicle 102 moves past a same marker 120. For example, if the vehicle 102 is moving in the first direction 116, the first sensor 110*a* is positioned a distance L1 from marker 120*a*, and second sensor 110*b* is positioned a distance L2 from marker 120*a*. Similarly, as the vehicle 102 passes marker 120*a*, third sensor 112*a* is a distance L3 from marker 120*a*, and fourth sensor 112*b* is a distance L4 from marker 120*a*. The corresponding distances L1, L2, L3 and L4 are not shown in FIG. 1 to avoid obscuring the drawing.

The first sensor 110*a* has a first inclination angle □□□ with respect to the detected marker 120. The second sensor 110*b* has a second inclination angle □□□ with respect to the detected marker 120 different from the first inclination angle □□□ The third sensor 112*a* has a third inclination angle □□□ with respect to the detected marker 120. The fourth sensor 112*b* has a fourth inclination angle □□□ with respect to the detected marker 120 of different from the fourth inclination angle □□□ In some embodiments, the discussed inclination angles □□□□□□□□□□□ and □□□ are measured with respect to a corresponding horizon line that is parallel to the guideway 114. The corresponding horizon line for each sensor of the first set of sensors 110 and each sensor of the second set of sensors 112 is separated from the marker 120 by the corresponding distance L of each sensor of the first set of sensors 110 or each sensor of the second set of sensors 112.

In some embodiments, inclination angle □□□ is substantially equal to inclination angle □□□□ and inclination angle □□□ is substantially equal to inclination angle □□□□□ If the markers 120 are on the guideway, then the sensors of the first set of sensors 110 and the sensors of the second set of sensors 112 are directed toward the guideway 114. In some embodiments, if the vehicle 102 is configured to move over the guideway 114, and the markers 120 are on the guideway, then the sensors of the first set of sensors 110 and the sensors of the second set of sensors 112 are directed downward toward the guideway 114. If the markers 120 are along the guideway 114 on the wayside of the guideway 114, then the sensors of the first set of sensors 110 and the sensors of the second set of sensors 112 are directed toward the wayside of the guideway 114.

Each of the sensors of the first set of sensors 110 and the sensors of the second set of sensors 112 has a corresponding field of view. Sensor 110*a* has a field of view 122*a* that is based on the position of sensor 110*a* on the first end 104 of the vehicle 102 and inclination angle □□□□□ Sensor 110*b* has a field of view 122*b* that is based on the position of sensor 110*b* on the first end 104 of the vehicle 102 and inclination angle □□□□□ Sensor 112*a* has a field of view 124*a* that is based on the position of sensor 112*a* on the second end 106 of the vehicle 102 and inclination angle □□□□□ Sensor 112*b* has a field of view 124*b* that is based on the position of sensor 112*b* on the second end 106 of the vehicle 102 and inclination angle □□□

Field of view 122*a* overlaps with field of view 122*b*, and field of view 124*a* overlaps with field of view 124*b*. In some embodiments, one or more of field of view 122*a* and field of view 122*b* are non-overlapping, or field of view 124*a* and field of view 124*b* are non-overlapping. The position and inclination angle of each sensor 110 of the first set of sensors 110 is such that a detected marker 120 enters one of the field of view 122*a* or 122*b*, first, based on the direction the vehicle 102 moves along the guideway 114. Similarly, the position and inclination angle of each sensor 112 of the second set of sensors 112 is such that a detected marker 120 enters one of the field of view 124*a* or 124*b*, first, based on the direction the vehicle 102 moves along the guideway 114. In some embodiments, the markers 120 are spaced along the guideway 114 such that only one of the markers 120 is within field of view 122*a* or 122*b* at a time. Similarly, in some embodiments, the markers 120 are spaced along the guideway 114 such that only one of the markers 120 is within field of view 124*a* or 124*b* at a time. In some embodiments, the markers 120 are spaced along the guideway 114 such that only one of the markers 120 is within field of view 122*a*, 122*b*, 124*a* or 124*b* at a time. In some embodiments, markers 120 are spaced along the guideway 114 such that only one marker 120 is detected by the sensors of the first set of sensors 110 or the sensors of the second set of sensors 112 at a time. That is, in some embodiments, a marker 120 is within field of view 122*a* and 122*b*, or within field of view 124*a* and 124*b*.

In some embodiments, the markers 120 are separated by a distance d that results in there being non-detection time between consecutive marker 120 detections as the vehicle 102 moves along the guideway 114. For example, the markers 120 are separated by a distance d that results in there being a non-detection time to a detection time ratio that is at least about 0.40. In some embodiments, the ratio of non-detection time to detection time is at least about 0.50.

In some embodiments, the distance d between consecutive markers 120 is such that a ratio of a detection span I of the sensors (e.g., the first set of sensors 110 and the second set of sensors 112) to the distance d between consecutive markers 120 is less than about 0.50. For example, if the detection span I of a sensor with respect to a surface where the markers 120 reside is based on equation (1), below $$I=L(1/tg(\gamma-1/2\mathrm{FOV})-1/tn(\gamma+1/2\mathrm{FOV})) \quad (1)$$

where:

I is the detection span of the sensor,

L is the separation distance between the sensor and the marker in a direction perpendicular to the direction of movement of the vehicle, γ is the inclination angle of the sensor, and FOV is the field of view of the sensor.

In some embodiments, markers 120 that have a distinct difference between consecutive markers 120 (e.g. a sharp rising edge or a sharp falling edge upon the detection of a next marker 120) makes it possible to reduce the distance d between consecutive markers 120 compared to other embodiments in which the markers 120 are separated by a distance d that is greater than about twice the detection span I, or embodiments in which the ratio of non-detection time to detection time being greater than about 0.50, for example.

In some embodiments, the distance d between consecutive markers 120 is set based on one or more of the velocity of the vehicle 102, processing time and delays of the controller 108, field of view 122*a*, 122*b*, 124*a* and/or 124*b*, the inclination angles □□□□□□□□□□□□□ and/or □□□□ the separation distances L1, L2, L3 and/or L4 between the sensors and the markers 120, and/or a width of each marker 120 measured in the direction of movement of the vehicle 102.

Sensors of the first set of sensors 110 and sensors of the second set of sensors 112 are one or more of radio detection and ranging ("RADAR") sensors, laser imaging detection and ranging ("LIDAR") sensors, cameras, infrared-based sensors, or other suitable sensors configured to detect an object or pattern of objects such as markers 120.

The controller 108 is configured to determine which of the first end 104 or the second end 106 of the vehicle 102 is the leading end of the vehicle 102 as the vehicle 102 moves along the guideway 114, determine a position of the leading end of the vehicle 102 with respect to a detected marker 120, determine a position of the vehicle 102 with respect to a detected marker 120, and determine a velocity of the vehicle 102 as the vehicle 102 moves along the guideway 114.

In some embodiments, the controller 108 is configured to use one or more of the sensor data generated by the first sensor 110*a* or the second sensor 110*b* of the first set of sensors 110 as the sensor data for determining the leading end of the vehicle 102, the position of the leading end of the vehicle 102, the velocity of the vehicle 102, the velocity of the leading end of the vehicle 102, the position of the other end of the vehicle 102, and/or the velocity of the other end of the vehicle 102. Similarly, the controller 108 is configured to use one or more of the sensor data generated by the third sensor 112*a* or the fourth sensor 112*b* of the second set of sensors 112 as the sensor data for determining the leading end of the vehicle 102, the position of the leading end of the vehicle 102, the velocity of the vehicle 102, the velocity of the leading end of the vehicle 102, the position of the other end of the vehicle 102, and/or the velocity of the other end of the vehicle 102.

In some embodiments, the controller 108 is configured to fuse sensor data generated by different sensors of the first set of sensors 110 and/or the second set of sensors 112 by averaging, comparing, and/or weighting sensor data that is collected by the sensors of the first set of sensors 110 and/or the sensors of the second set of sensors 112 to generate fused sensor data. The controller 108 is then configured to use the fused sensor data as the sensor data for determining the leading end of the vehicle 102, calculating the distance the vehicle traveled, and/or the velocity of the vehicle 102. In some embodiments, the controller 108 is configured to calculate the distance traveled from a first marker 120 based on a fusion of the sensor data generated by the first set of sensors 110 or the second set of sensors 112. In some embodiments, the controller 108 is configured to calculate the distance traveled from a first marker 120 based on a fusion of the sensor data generated by the first set of sensors 110 and the second set of sensors 112. In some embodiments, the controller 108 is configured to calculate the velocity of the vehicle 102 based on a fusion of the sensor data generated by the first set of sensors 110 or the second set of sensors 112. In some embodiments, the controller 108 is configured to calculate the velocity of the vehicle 102 based on a fusion of the sensor data generated by the first set of sensors 110 and the second set of sensors 112.

To determine which of the first end 104 or the second end 106 of the vehicle 102 is the leading end of the vehicle 102 as the vehicle 102 moves along the guideway 114, the controller 108 is configured to compare a time the first sensor 110*a* detected a marker 120 with a time the second sensor 110*b* detected the marker 120, and to identify the first end 104 or the second end 106 as a leading end of the vehicle 102 based on the comparison of the time the first sensor 110*a* detected the marker 120 with the time the second sensor 110*a* detected the marker. For example, if the vehicle 102 is moving in the first direction 116, and the first end 104 of the vehicle 102 is already beyond marker 120*a*, marker 120*a* would have entered field of view 122*a* before marker 120*a* entered field of view 122*b*. Based on a determination that marker 120*a* entered field of view 122*a* before marker 120*a* entered field of view 122*b*, the controller 108 determines that the first end 104 of the vehicle 102 is the leading end of the vehicle 102. But, if the vehicle 102 is moving in the second direction 118, and the first end 104 of the vehicle 102 has not yet traveled beyond marker 120*a*, marker 120*a* will enter field of view 122*b* before marker 120*a* will enter field of view 122*a*. If the vehicle 102 continues moving in the second direction 118 such that the first set of sensors 110 detect marker 120*a*, based on a determination that marker 120*a* entered field of view 122*b* before marker 120*a* entered field of view 122*a*, the controller 108 determines that the second end 106 of the vehicle 102 is the leading end of the vehicle 102.

In some embodiments, the controller 108 is configured to determine which of the first end 104 or the second end 106 is the leading end of the vehicle based on a determination of whether a relative velocity $V_{RELATIVE}$ of the sensors of the first set of sensors 110 or the sensors of the second set of sensors 112 with respect to a detected marker 120 is a positive or a negative value. For example, if the sensors of the first set of sensors 110 detect a marker 120 that is ahead of the vehicle 102 as the vehicle 102 moves in the first direction 116, the relative velocity $V_{RELATIVE}$ is negative as the sensors of the first set of sensors 110 "approach" the marker 120. If the sensors of the second set of sensors 112 detect a marker 120 that is behind the vehicle 102 as the vehicle 102 moves in the first direction 116, the relative velocity $V_{RELATIVE}$ is positive as the sensors of the second set of sensors 112 "depart" from the marker 120.

To determine the position of the vehicle 102, the controller 108 is configured to query the memory 109 for information describing a detected marker 120. For example, the memory 109 includes location information describing the geographic location of the detected marker 120. In some embodiments, the memory 109 includes location information describing the distance d between marker 120 and a previously detected marker 120. The controller 108 uses the location information to calculate a position of the leading end of the vehicle 102 based on the sensor data generated by one or more of the first sensor 110*a* or the second sensor 110*b*. For example, the controller 108 is configured to calculate the position of the leading end of the vehicle 102 based on the distance d between marker 120*a* and marker 120*b*.

In some embodiments, the controller 108 is configured to calculate the position of the leading end of the vehicle 102 based on a calculated velocity of the vehicle 102 and a duration of time since the sensors of the first set of sensors 110 or the sensors of the second set of sensors 112 detected a marker 120. In some embodiments, the position of the leading end of the vehicle 102 is determined with respect to the last detected marker 120. In other embodiments, the controller 108 is configured to calculate the geographic location of the leading end of the vehicle 108. In some embodiments, the controller 108 is configured to calculate the position of the other of the first end 104 or the second end 106 that is determined by the controller 108 to be other than the leading end of the vehicle 102 with respect to the leading end of the vehicle 102 based on a length q of the vehicle 102.

In some embodiments, consecutive markers 120 are pairs of markers separated by a distance d stored in memory 109. The controller 108 is configured to count a quantity of markers 120 detected by the first set of sensors 110 or the second set of sensors 112 during a predetermined duration of time, search the memory 109 for the stored distance d between each pair of consecutive markers 120 detected during the predetermined duration of time, and add the distances d between each pair of consecutive markers 120 for the quantity of markers 120 that are detected to determine a total distance the vehicle 102 traveled during the predetermined duration of time.

In some embodiments, the controller 108 is configured to count a quantity of pattern elements detected since a particular marker 120 was detected, and to add the distance d between the detected quantity to determine the distance the vehicle traveled over a predetermined duration of time. In some embodiments, the controller 108 is configured to integrate the velocity of the vehicle 102 in the time domain to determine the distance the vehicle traveled. If, for example, the distance d between consecutive markers is greater than a predetermined distance, then the controller 108 is configured to determine the distance the vehicle 102 traveled based on the integral of the velocity of the vehicle in the time domain. Then, upon the detection of a next marker 102, the controller 108 is configured to use the distance d between the consecutive markers 120 to correct the distance the vehicle 102 traveled.

In some embodiments, the controller 108 is configured to calculate the distance traveled by the vehicle 102, if the distance d between the markers 120 is substantially equal, based on equation (2), below $$D=(n-1)*d \tag{2}$$

where:

D is the traveled distance from a particular marker, n is the quantity of markers detected in the duration of time since the particular marker was detected, and d is the separation distance between two consecutive markers.

In some embodiments, the controller 108 is configured to calculate the distance traveled by the vehicle 102, if the vehicle 102 is traveling at a velocity and the time interval between consecutive markers 120 is constant, based on equation (3), below $$D=\Sigma V\Delta t \tag{3}$$

where:

D is the traveled distance from a known marker over a predetermined duration of time, V is the velocity of the vehicle, and Δt is the predetermined duration of time.

In some embodiments, the sensors of the first set of sensors 110 and the sensors of the second set of sensors 112 are configured to determine a distance between the sensor and the detected marker 120 in the field of view of the sensor along the line of sight of the sensor. In some embodiments, the controller 108 is configured to use the distance between the sensor and the detected marker 120 to calculate the position of the vehicle 102.

The controller 108 is configured to calculate the velocity of the vehicle based on the distance the vehicle 102 traveled within a predetermined duration of time. In some embodiments, the predetermined duration of time has an interval ranging from about 1 second to about 15 minutes.

In some embodiments, the controller 108 is configured to calculate the velocity of the vehicle 102 based on a quantity of markers 120 detected within a predetermined duration of time and the distance d between consecutive markers 120*d* uration. In some embodiments, the controller 108 is configured to calculate the velocity of the vehicle 102 based on a relative velocity $V_{RELATIVE}$ between the sensors of the first set of sensors 110 and/or the sensors of the second set of sensors 112 and the detected marker 120. In some embodiments, the relative velocity $V_{RELATIVE}$ is based on a calculated approach or departure speed of the sensors with respect to a detected marker 120. The controller 108 is configured to use the relative velocity $V_{RELATIVE}$ of the sensors of the first set of sensors 110 and/or the sensors of the second set of sensors 112 if the distance d between the markers 120 is greater than a predefined threshold until a next marker 120 is detected. Upon the detection of a next marker 120, the controller 108 is configured to calculate the velocity of the vehicle 102 based on the distance the vehicle 102 traveled over the duration of time since the sensors of the first set of sensors 110 and/or the sensors of the second set of sensors 112 last detected a marker 120. In some embodiments, the sensors of the first set of sensors 110 and the sensors of the second set of sensors 112 are configured to determine the relative velocity $V_{RELATIVE}$ with respect to a detected marker 120 in the field of view of the sensor along the line of sight of the sensor.

In some embodiments, the controller 108 is configured to calculate the velocity of the vehicle, if the distance d between the markers 120 is substantially equal, based on equation (4), below, $$V=(n-1)*d/t \tag{4}$$

where

V is the velocity of the vehicle, n is the quantity of markers detected within the predetermined duration of time, d is the distance between consecutive markers, and t is the predetermined duration of time.

In some embodiments, the controller 108 is configured to calculate the velocity of the vehicle based on the relative velocity $V_{RELATIVE}$ based on equation (5), below $$V=V_{RELATIVE}/\mathrm{Cos}(\ominus) \tag{5}$$

where

V is the velocity of the vehicle, $V_{RELATIVE}$ is the relative speed between a sensor and the detected marker, and $\ominus$ is the inclination angle of the sensor.

In some embodiments, the controller 108 is configured to combine different techniques of determining the distance the vehicle 102 traveled from a particular marker 120, the position of the vehicle 102, and/or the velocity of the vehicle 102.

To combine the different techniques of determining the distance the vehicle 102 traveled from a particular marker 120, the controller 108 is configured to average a first calculated distance and a second calculated distance. For example, the first calculated distance that the vehicle 102 traveled is based on the quantity of markers 120 detected (e.g., equation 2), and the second calculated distance that the vehicle 102 traveled is based on the integration of the velocity of the vehicle 102 in the time domain (e.g., equation 3). In some embodiments, the controller 108 is configured to weight the first calculated distance or the second calculated distance based on a preset weighting factor. For example, if the first calculated distance is likely more accurate than the second calculated distance based on various factors, then the controller 108 is configured to give the first calculated distance a higher weight than the second calculated distance when averaging the first calculated distance and the second calculated distance. Similarly, if the second calculated distance is likely more accurate than the first calculated distance based on various factors, then the controller 108 is configured to give the second calculated distance a higher weight than the first calculated distance when averaging the first calculated distance and the second calculated distance.

In some embodiments, the controller 108 is configured to use a speed-based weighted average of a first calculated distance that the vehicle 102 traveled based on the quantity of markers 120 detected and a second calculated distance that the vehicle 102 traveled based on the integration of the velocity of the vehicle 102 in the time domain. For example, if the vehicle 102 is moving at a speed lower than a threshold value, then the controller 108 is configured to give the distance traveled based on the integral of the velocity of the vehicle 102 in the time domain a higher weight than the distance d that the vehicle 102 traveled based on the quantity of markers 120 detected, because the time interval between consecutive markers 120 is greater than if the vehicle 102 is traveling at a velocity greater than the threshold value. For example, if the vehicle is moving at a speed greater than the threshold value, then the controller 108 is configured to give the distance traveled based on the distances d between the quantity of markers 120 detected a higher weight than the distance traveled based on the integral of the velocity of the vehicle 102 in the time domain.

To combine the different techniques of determining the velocity of the vehicle 102, the controller 108 is configured to average a first calculated velocity and a second calculated velocity. For example, the first calculated velocity of the vehicle 102 is based on the quantity of markers 120 detected within the predetermined duration of time (e.g., equation 4) and the second calculated velocity based on the relative velocity $V_{RELATIVE}$ between the sensors of the first set of sensors 110 and/or the sensors of the second set of sensors 112 and the markers 120 (e.g., equation 5) duration. The controller 108 is configured to calculate the velocity of the vehicle 102 by averaging the first calculated velocity and the second calculated velocity if the distance d between consecutive markers 120 is below a predefined threshold. In some embodiments, the controller 108 is configured to weight the first calculated velocity or the second calculated velocity based on a preset weighting factor. For example, if the first calculated velocity is likely more accurate than the second calculated velocity based on various factors, then the controller 108 is configured to give the first calculated velocity a higher weight than the second calculated velocity when averaging the first calculated velocity and the second calculated velocity. Similarly, if the second calculated velocity is likely more accurate than the first calculated velocity based on various factors, then the controller 108 is configured to give the second calculated velocity a higher weight than the first calculated velocity when averaging the first calculated velocity and the second calculated velocity.

In some embodiments, the average of the first calculated velocity and the second calculated velocity is a speed-based weighted average. For example, if the velocity of the vehicle is below a predefined threshold, then the controller 108 is configured to give the calculated velocity based on the relative velocity $V_{RELATIVE}$ between the sensors of the first set of sensors 110 and/or the sensors of the second set of sensors 112 and the markers 120 a higher weight than the velocity of the vehicle calculated based on the quantity of detected markers 120. For example, if the velocity of the vehicle 102 is greater than the predefined threshold, then the controller 108 is configured to give the velocity calculated based on the quantity of markers 120 detected during the predetermined duration of time a higher weight than the velocity of the vehicle 102 based on the relative velocity $V_{RELATIVE}$ between the sensors of the first set of sensors 110 and/or the sensors of the second set of sensors 112 and the markers 120.

The controller 108 is configured to perform consistency checks to compare the determinations or calculations that are based on the sensor data generated by the sensors of the first set of sensors 110 and the sensors of the second set of sensors 112. For example, the controller 108 is configured to determine if a leading end determination based on the sensor data generated by the first sensor 110*a* matches a leading end determination based on the sensor data generated by the second sensor 110*b*. The controller 108 is also configured to determine if a position or distance traveled calculation based on the sensor data generated by the first sensor 110*a* matches a corresponding position or distance traveled calculation based on the sensor data generated by the second sensor 110*b*. The controller 108 is further configured to determine if a velocity calculation based on the sensor data generated by the first sensor 110*a* matches a velocity calculation based on the sensor data generated by the second sensor 110*b*.

In some embodiments, the controller 108 is configured to determine if a leading end determination based on the sensor data generated by the sensors of the first set of sensors 110 matches a leading end determination based on the sensor data generated by the sensors of the second set of sensors 112. In some embodiments, the controller 108 is configured to determine if a position or distance traveled calculation based on the sensor data generated by the sensors of the first set of sensors 110 matches a corresponding position or distance traveled calculation based on the sensor data generated by the sensors of the second set of sensors 112. In some embodiments, the controller 108 is configured to determine if a velocity calculation based on the sensor data generated by the sensors of the first set of sensors 110 matches a velocity calculation based on the sensor data generated by the sensors of the second set of sensors 112.

The controller 108 is configured to identify one or more of the first sensor 110*a*, the second sensor 110*b*, the third sensor 112*a* or the fourth sensor 112*b* as being faulty based on a determination that a mismatch between one or more of the calculated leading end of the vehicle 102, the calculated position of the vehicle 102, the calculated distance the vehicle 102 traveled, or the calculated velocity of the vehicle 102 results in a difference between the calculated values that is greater than a predefined threshold. The controller 108, based on a determination that at least one of the sensors is faulty, generates a message indicating that at least one of the sensors is in error. In some embodiments, the controller 108 is configured to identify which sensor of the first set of sensors 110 or the second set of sensors 112 is the faulty sensor. In some embodiments, to identify the faulty sensor, the controller 108 is configured to activate one or more of the first auxiliary sensor 110*c* or the second auxiliary sensor 112*c*, and compare a calculated value of the first set of sensors 110 or the second set of sensor 112 for the leading end of the vehicle 102, the position of the vehicle 102, the distance the vehicle 102 traveled and/or the velocity of the vehicle 102 with the corresponding sensor data generated by one or more of the first auxiliary sensor 110*c* or the second auxiliary sensor 112*c*. The controller 108 is configured to identify which of the first sensor 110*a*, the second sensor 110*b*, the third sensor 112*a* and/or the fourth sensor 112*b* is faulty based on a determination that at least one of the calculated values of the first set of sensors 110 or the second set of sensor 112 matches the calculated value based on the sensor data generated by the first auxiliary 110*c* and/or the second auxiliary sensor 112*c* within the predefined threshold.

In some embodiments, the controller 108 is configured to calculate a first velocity of the leading end of the vehicle 102 based on the sensor data generated by the set of sensors on the end of the vehicle 102 identified as being the leading end of the vehicle 102, and calculate a second velocity of the other of the first end or the second end that is other than the leading end of the vehicle 102 based on the sensor data generated by the set of sensors on the end of the vehicle 102 that is other than the leading end of the vehicle 102. The controller 108 is also configured to generate an alarm based on a determination that a magnitude of the first velocity differs from a magnitude of the second velocity by more than a predefined threshold. In some embodiments, if the first velocity differs from the second velocity by more than the predefined threshold, the controller 108 is configured to cause the vehicle 102 to be braked to a stop via an emergency brake actuated by the controller 108.

Similarly, in some embodiments, the controller 108 is configured to generate an alarm if the position of the leading end of the vehicle 102 calculated based on the sensor data generated by one of more of the first sensor 110*a* or the second sensor 110*b* differs from the position of the leading end of the vehicle 102 calculated based on the sensor data generated by one or more of the third sensor 112*a* or the fourth sensor 112*b* by more than a predefined threshold. For example, if the first end 104 of the vehicle 102 is determined to be the leading end of the vehicle 102, the first set of sensors 110 are closer to the leading end of the vehicle 102 than the second set of sensors 112. The controller 108 is configured to determine the position of the leading end of the vehicle 102 based on the sensor data generated by the first set of sensors 110, and based on the sensor data generated by the second set of sensors 112 in combination with the length q of the vehicle 102. If the position of the leading end of the vehicle 102 based on the sensor data generated by the first set of sensors 110 differs from the position of the leading end of the vehicle 102 based on the combination of the sensor data generated by the second set of sensors 112 and the length q of the vehicle 102 by more than the predefined threshold, such a difference could be indicative of an unexpected separation between the first end 104 and the second end 106 of the vehicle 102. Alternatively, such a difference between calculated position of the leading end of the vehicle could be an indication that there is a crumple zone between the first end 104 and the second end 106 of the vehicle.

In some embodiments, if the calculated position of the leading end of the vehicle 102 based on the sensor data generated by the first set of sensors differs from the position of the leading end of the vehicle based on the sensor data generated by the second set of sensors by more than the predefined threshold, the controller 108 is configured to cause the vehicle 102 to be braked to a stop via an emergency brake actuated by the controller 108.

The system 100 eliminates the need for wheel spin/slide detection and compensation and wheel diameter calibration. Wheel circumference sometimes varies by about 10-20%, which results in about a 5% error in velocity and/or position/distance traveled determinations that are based on wheel rotation and/or circumference. Additionally, slip and slide conditions also often cause errors in velocity and/or position/distance traveled determinations during conditions which result in poor traction between a wheel of the vehicle 102 and the guideway 114, even with the use of accelerometers because of variables such as vehicle jerking.

The sensors of the first set of sensors 110 and the sensors of the second set of sensors 112 are positioned on the first end 104 or the second end 106 of the vehicle 102 independent of any wheel and/or gear of the vehicle 102. As a result the calculated velocity of the vehicle 102, position of the vehicle 102, distance traveled by the vehicle 102, or the determination of the leading end of the vehicle 102 are not sensitive to wheel spin or slide or wheel diameter calibration errors, making the calculations made by the system 100 more accurate than wheel-based or gear-based velocity or position calculations. In some embodiments, the system 100 is capable of calculating the speed and/or the position of the vehicle 102 to a level of accuracy greater than wheel-based or gear-based techniques, even at low speeds, at least because the sensors of the first set of sensors 110 and the sensors of the second set of sensors 112 make it possible to calculate a distance traveled from, or a positional relationship to, a particular marker 120 to within about +/−5 centimeters (cm).

Additionally, by positioning the sensors of the first set of sensors 110 and the sensors of the second set of sensors 112 away from the wheels and gears of the vehicle, the sensors of the first set of sensors 110 and the sensors of the second set of sensors 112 are less likely to experience reliability issues and likely to require less maintenance compared to sensors that are installed on or near a wheel or a gear of the vehicle 102.

In some embodiments, system 100 is usable to determine if the vehicle 102 moved in a power-down mode. For example, if the vehicle 102 is powered off today, the vehicle optionally re-establishes positioning before the vehicle can start moving along the guideway 114. On start-up, the controller 108 is configured to compare a marker 120 detected by the sensors of the first set of sensors 110 or the sensors of the second set of sensors 112 with the marker 120 that was last detected before the vehicle was powered down. The controller 108 is then configured to determine that the vehicle 102 has remained in the same location as when the vehicle 102 was powered-down if the marker 120 last detected matches the marker 120 detected upon powering-on vehicle 102.

Figure 2:
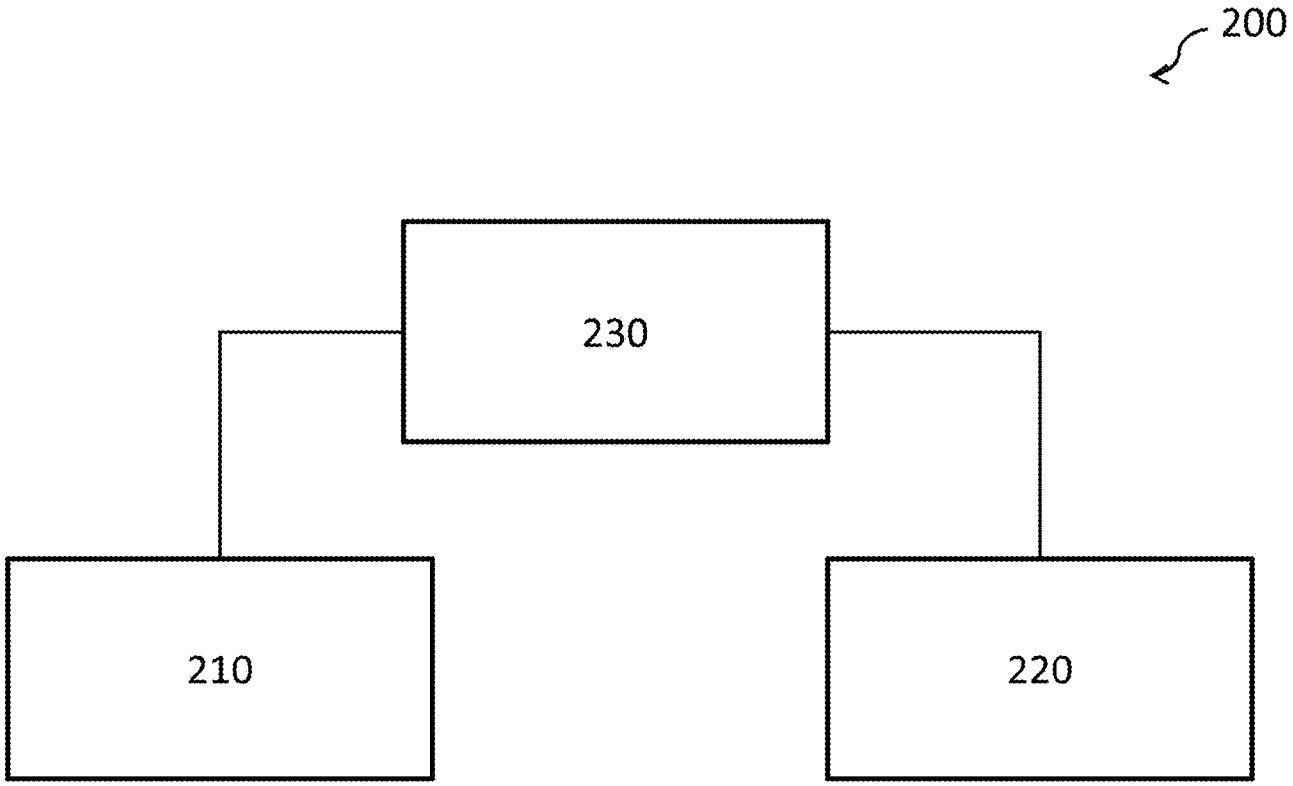
FIG. 2 is a block diagram of a fusion sensor arrangement in accordance with one or more embodiments.

FIG. 2 is a block diagram of a fusion sensor arrangement 200 in accordance with one or more embodiments. Fusion sensor arrangement 200 includes first sensor 210 configured to receive a first type of information. Fusion sensor arrangement 200 further includes a second sensor 220 configured to receive a second type of information. In some embodiments, the first type of information is different from the second type of information. Fusion sensor arrangement 200 is configured to fuse information received by first sensor 210 with information received by second sensor 220 using a data fusion center 230. Data fusion center 230 is configured to determine whether a marker 120 (FIG. 1) is detected within a detection field of either first sensor 210 or second sensor 220. Data fusion center 230 is also configured to resolve conflicts between first sensor 210 and second sensor 220 arising when one sensor provides a first indication and the other sensor provides another indication.

In some embodiments, fusion sensor arrangement 200 is usable in place of one or more of the first sensor 110*a* (FIG. 1), the second sensor 110*b* (FIG. 1), the first auxiliary sensor 110*c* (FIG. 1), the third sensor 112*a* (FIG. 1), the fourth sensor 112*b* (FIG. 1), or the second auxiliary sensor 112*c* (FIG. 1). In some embodiments, first sensor 210 is usable in place of first sensor 110*a* and second sensor 220 is usable in place of second sensor 110*b*. Similarly, in some embodiments, first sensor 210 is usable in place of the third sensor 112*a*, and second sensor 220 is usable in place of fourth sensor 112*b*. In some embodiments, data fusion center 230 is embodied within controller 108. In some embodiments, controller 108 is data fusion center 230. In some embodiments, data fusion arrangement 200 includes more than the first sensor 210 and the second sensor 220.

In some embodiments, first sensor 210 and/or second sensor 220 is an optical sensor configured to capture information in a visible spectrum. In some embodiments, first sensor 210 and/or second sensor 220 includes a visible light source configured to emit light which is reflected off objects along the guideway or the wayside of the guideway. In some embodiments, the optical sensor includes a photodiode, a charged coupled device (CCD), or another suitable visible light detecting device. The optical sensor is capable of identifying the presence of objects as well as unique identification codes associated with detected objects. In some embodiments, the unique identification codes include barcodes, alphanumeric sequences, pulsed light sequences, color combinations, geometric representations or other suitable identifying indicia.

In some embodiments, first sensor 210 and/or second sensor 220 includes a thermal sensor configured to capture information in an infrared spectrum. In some embodiments, first sensor 210 and/or second sensor 220 includes an infrared light source configured to emit light which is reflected off objects along the guideway or the wayside of the guideway. In some embodiments, the thermal sensor includes a Dewar sensor, a photodiode, a CCD or another suitable infrared light detecting device. The thermal sensor is capable of identifying the presence of an object as well as unique identifying characteristics of a detected object similar to the optical sensor.

In some embodiments, first sensor 210 and/or second sensor 220 includes a RADAR sensor configured to capture information in a microwave spectrum. In some embodiments, first sensor 210 and/or second sensor 220 includes a microwave emitter configured to emit electromagnetic radiation which is reflected off objects along the guideway or the wayside of the guideway. The RADAR sensor is capable of identifying the presence of an object as well as unique identifying characteristics of a detected object similar to the optical sensor.

In some embodiments, first sensor 210 and/or second sensor 220 includes a laser sensor configured to capture information within a narrow bandwidth. In some embodiments, first sensor 210 and/or second sensor 220 includes a laser light source configured to emit light in the narrow bandwidth which is reflected off objects along the guideway or the wayside of the guideway. The laser sensor is capable of identifying the presence of an object as well as unique identifying characteristics of a detected object similar to the optical sensor.

First sensor 210 and second sensor 220 are capable of identifying an object without additional equipment such as a guideway map or location and speed information. The ability to operate without additional equipment decreases operating costs for first sensor 210 and second sensor 220 and reduces points of failure for fusion sensor arrangement 200.

Data fusion center 230 includes a non-transitory computer readable medium configured to store information received from first sensor 210 and second sensor 220. In some embodiments, data fusion center 230 has connectivity to memory 109 (FIG. 1). Data fusion center 230 also includes a processor configured to execute instructions for identifying objects detected by first sensor 210 or second sensor 220. The processor of data fusion center 230 is further configured to execute instructions for resolving conflicts between first sensor 210 and second sensor 220.

Data fusion center 230 is also capable of comparing information from first sensor 210 with information from second sensor 220 and resolving any conflicts between the first sensor and the second sensor.

In some embodiments, when one sensor detects an object but the other sensor does not, data fusion center 230 is configured to determine that the object is present. In some embodiments, data fusion center 230 initiates a status check of the sensor which did not identify the object.

The above description is based on the use of two sensors, first sensor 210 and second sensor 220, for the sake of clarity. One of ordinary skill in the art would recognize that additional sensors are able to be incorporated into fusion sensor arrangement 200 without departing from the scope of this description. In some embodiments, redundant sensors which are a same sensor type as first sensor 210 or second sensor 220 are included in fusion sensor arrangement 200.

Figure 3A:
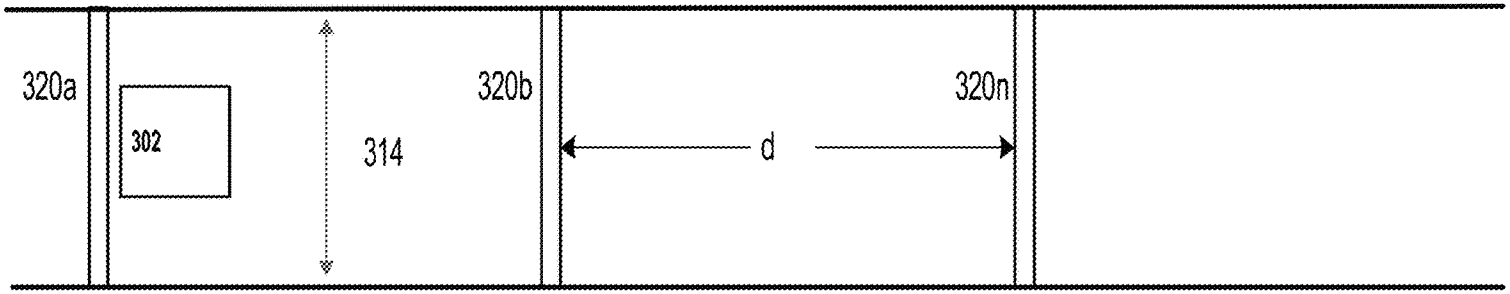
FIG. 3A is a top-side view of a guideway mounted vehicle, in accordance with one or more embodiments.

FIG. 3A is a top-side view of a guideway mounted vehicle 302, in accordance with one or more embodiments. Vehicle 302 comprises the features discussed with respect to vehicle 102 (FIG. 1). Vehicle 302 includes vehicle localization system 100 (FIG. 1), and is configured to move over guideway 314. Guideway 314 is a two-rail example of guideway 114 (FIG. 1). Markers 320*a*-320*n*, where n is an integer greater than 1, correspond to markers 120 (FIG. 1). Markers 320*a*-320*n* are on the guideway 314. In this example embodiment, markers 320*a*-320*n* are railroad ties separated by the distance d.

Figure 3B:
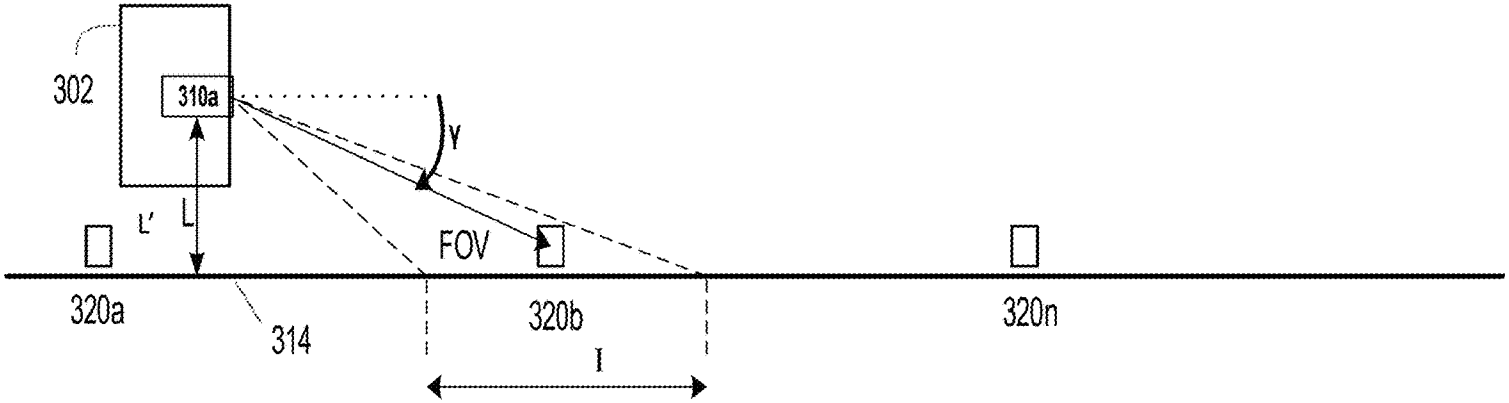
FIG. 3B is a side view of vehicle, in accordance with one or more embodiments.

FIG. 3B is a side view of vehicle 302, in accordance with one or more embodiments. Vehicle 302 is configured to travel over markers 320*a*-320*n*. First sensor 310*a* corresponds to first sensor 110*a* (FIG. 1). First sensor 310*a* is positioned on the first end of vehicle 302 at a distance L' from the guideway 314. First sensor 31.0*a* is directed toward the guideway 314 to detect markers 320*a*-320*n*. Accordingly, first sensor 310*a* has an inclination angle □□ that corresponds to inclination angle □□ (FIG. 1) of the first sensor 110*a*. First sensor 310*a* has a field of view FOV that corresponds to field of view 122*a* (FIG. 1). Based on the inclination angle □, the field of view FOV, and the distance L', first sensor 310*a* has a detection span I (as calculated based on equation 1). One of ordinary skill would recognize that the sensors of the first set of sensors 110 (FIG. 1) and the sensors of the second set of sensors 112 (FIG. 1) have properties similar to those discussed with respect to sensor 310*a* that vary based on the position of the sensor on the vehicle 102.

Figure 4A:
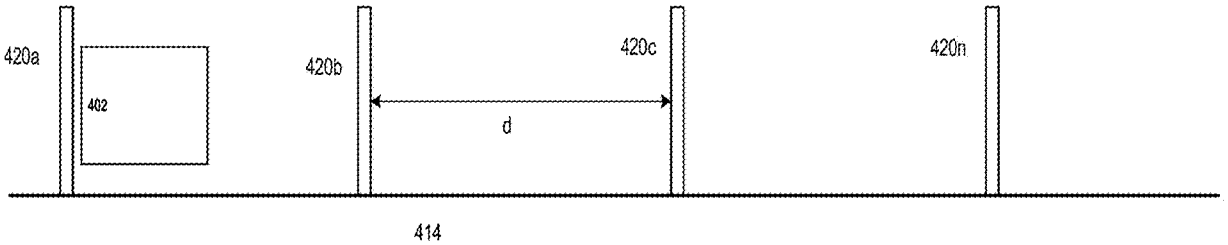
FIG. 4A is a side view of a guideway mounted vehicle, in accordance with one or more embodiments.

FIG. 4A is a side view of a guideway mounted vehicle 402, in accordance with one or more embodiments. Vehicle 402 comprises the features discussed with respect to vechicle 102 (FIG. 1). Vehicle 402 includes vehicle localization system 100 (FIG. 1), and is configured to move over guideway 414. Guideway 414 is a two-rail example of guideway 114 (FIG. 1). Markers 420*a*-420*n*, where n is an integer greater than 1, correspond to markers 120 (FIG. 1). Markers 420*a*-420*n* are on the wayside of the guideway 414. In this example embodiment, markers 420*a*-420*n* are posts on the wayside of the guideway 414 separated by the distance d.

Figure 4B:
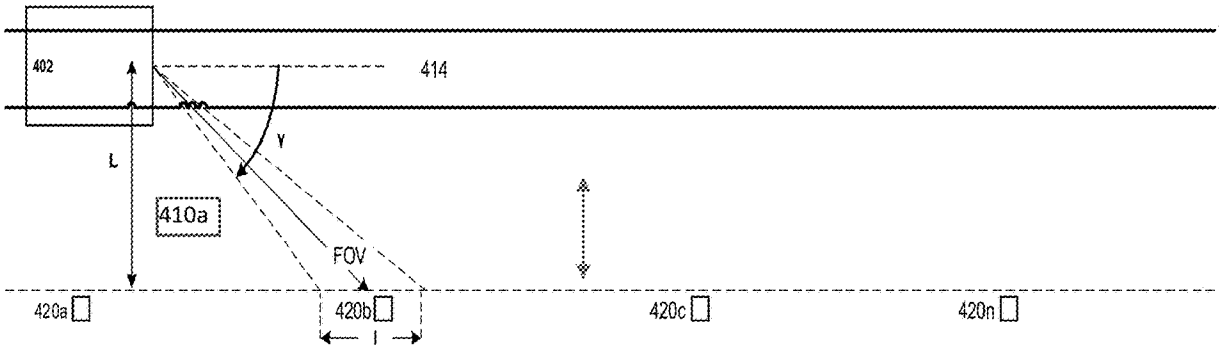
FIG. 4B is a top-side view of vehicle, in accordance with one or more embodiments.

FIG. 4B is a top-side view of vehicle 402, in accordance with one or more embodiments. Vehicle 402 is configured to travel over guideway 414. Markers 420*a*-420*n* are on the wayside of the guideway 414. First sensor 410*a* corresponds to first sensor 110*a* (FIG. 1). First sensor 410*a* is positioned on the first end of vehicle 402 at a distance L from the markers 420*a*-420*n*. First sensor 410*a* is directed toward markers 420*a*-420*n*. Accordingly, first sensor 410*a* has an inclination angle □□ that corresponds to inclination angle □□ (FIG. 1) of the first sensor 110*a*. First sensor 410*a* has a field of view FOV that corresponds to field of view 122*a* (FIG. 1). Based on the inclination angle □, the field of view FOV, and the distance L, first sensor 410*a* has a detection span I. One of ordinary skill would recognize that the sensors of the first set of sensors 110 (FIG. 1) and the sensors of the second set of sensors 112 (FIG. 1) have properties similar to those discussed with respect to sensor 410*a* that vary based on the position of the sensor on the vehicle 102.

Figure 5:
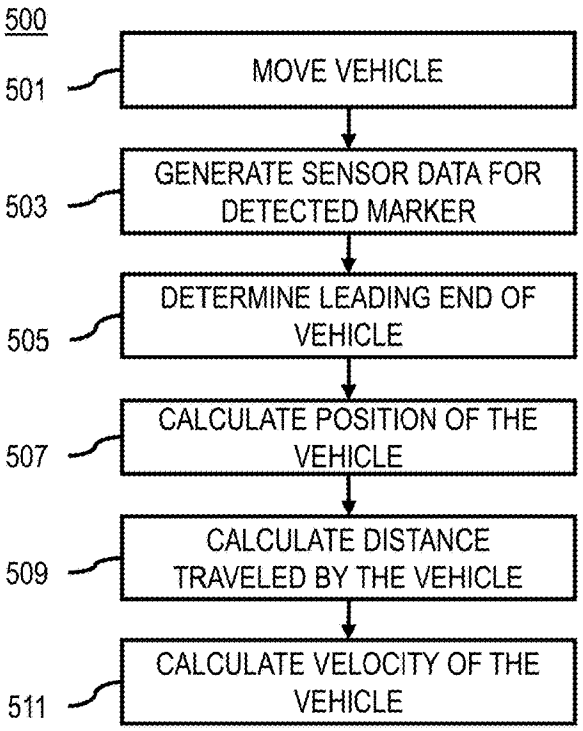
FIG. 5 is a flowchart of a method of determining a position, a distance traveled, and a velocity of a guideway mounted vehicle, in accordance with one or more embodiments.

FIG. 5 is a flowchart of a method 500 of determining a position, a distance traveled, and a velocity of a guideway mounted vehicle, in accordance with one or more embodiments. In some embodiments, one or more steps of method 500 is implemented by a controller such as controller 108 (FIG. 1).

In step 501, the vehicle moves from a start position such as a known or a detected marker in one of a first direction or a second direction.

In step 503, one or more sensors generate sensor data based on a detection of a marker of a plurality of markers using a set of sensors on the first end or on the second end of the vehicle. Each sensor of the set of sensors on the first end or the second end of the vehicle is configured to generate corresponding sensor data. In some embodiments, the sensors detect a pattern of objects on a guideway along which the vehicle moves, and the controller recognizes the pattern of objects as the detected marker of the plurality of markers based on data stored in a memory comprising information describing the detected marker of the plurality of markers.

In step 505, the controller compares a time a first sensor detected the marker of the plurality of markers with a time a second sensor detected the marker of the plurality of markers. Then, based on the time comparison, the controller identifies the first end or the second end as a leading end of the vehicle.

In step 507, the controller calculates a position of the vehicle by calculating one or more of a position of the leading end of the vehicle based on the sensor data generated by one or more of the first sensor or the second sensor, or calculating a position of the end of the vehicle that is other than the leading end of the vehicle based on the position of the leading end of the vehicle and a length of the vehicle.

In step 509, the controller calculates a distance the vehicle traveled from the start position or a detected marker. In some embodiments, the controller counts a quantity of markers of the plurality of markers detected by the set of sensors on the first end of the vehicle within a predetermined duration of time, and then calculates the distance the vehicle traveled during the predetermined duration of time based on a total quantity of the detected markers and the distance between each of the equally spaced markers of the plurality of markers.

In step 511, the controller calculates a velocity of the vehicle with respect to the detected marker of the plurality of markers based on the distance the vehicle traveled over a predetermined duration of time or a relative velocity of the vehicle with respect to the detected marker of the plurality of markers.

Figure 6:
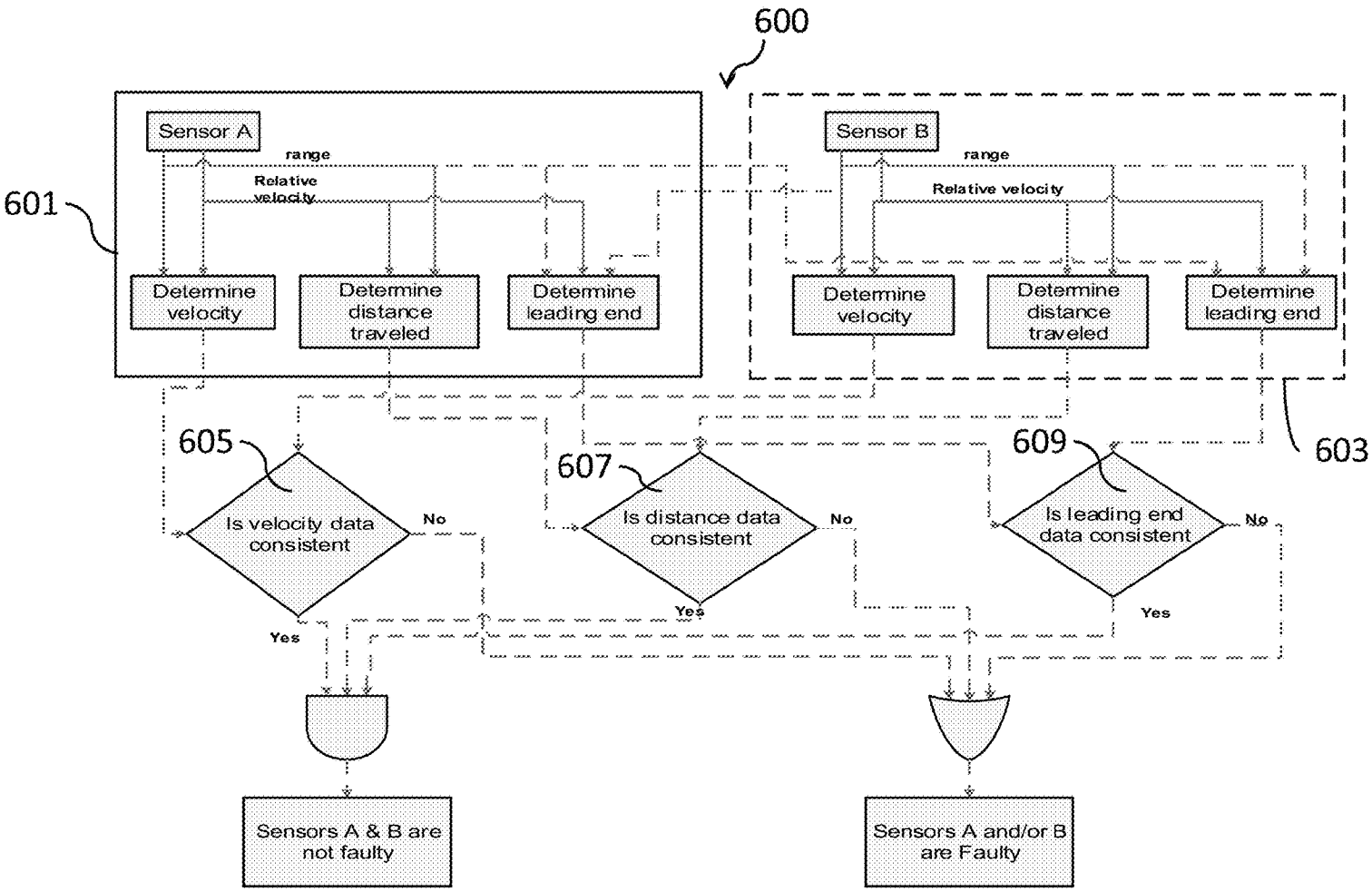
FIG. 6 is a flowchart of a method for checking consistency between the sensors on a same end of the vehicle, in accordance with one or more embodiments.

FIG. 6 is a flowchart of a method 600 for checking consistency between the sensors on a same end of the vehicle, in accordance with one or more embodiments. In some embodiments, one or more steps of method 600 is implemented by a controller such as controller 108 (FIG. 1) and a set of sensors A and B. Sensors A and B are a pair of sensors on a same end of the vehicle such as, the first set of sensors 110 (FIG. 1) or the second set of sensors 112 (FIG. 1).

In step 601, sensor A detects an object such as a marker 120 (FIG. 1) and generates sensor data based on the detected object. The sensor data comprises a range (e.g., distance) between sensor A and the detected object and the relative velocity of sensor A with respect to the detected object. Based on the sensor data generated by sensor A, the controller calculates the velocity of the vehicle, calculates the distance the vehicle traveled, and determines the leading end of the vehicle.

In step 603, sensor B detects the object and generates sensor data based on the detected object. The sensor data comprises a range (e.g., distance) between sensor B and the detected object and the relative velocity of sensor B with respect to the detected object. Based on the sensor data generated by sensor B, the controller calculates the velocity of the vehicle, calculates the distance the vehicle traveled, and determines the leading end of the vehicle.

In step 605, the controller compares the velocity of the vehicle that is determined based on the sensor data generated by sensor A with the velocity of the vehicle that is determined based on the sensor data generated by sensor B. In some embodiments, if the values match, then the controller determines sensor A and sensor B are functioning properly. If the values differ by more than a predefined tolerance, then the controller identifies one or more of sensor A or sensor B as being faulty. In some embodiments, if the velocity values match within the predefined threshold, then the controller is configured to use an average of the velocity values as the velocity of the vehicle.

In step 607, the controller compares the distance the vehicle traveled that is determined based on the sensor data generated by sensor A with the distance the vehicle traveled that is determined based on the sensor data generated by sensor B. In some embodiments, if the values match, then the controller determines sensor A and sensor B are functioning properly. If the values differ by more than a predefined tolerance, then the controller identifies one or more of sensor A or sensor B as being faulty. In some embodiments, if the distance values the vehicle traveled match within the predefined threshold, then the controller is configured to use an average of the distance traveled values as the distance the vehicle traveled.

In step 609, the controller compares the leading end of the vehicle that is determined based on the sensor data generated by sensor A with the leading end of the vehicle that is determined based on the sensor data generated by sensor B. In some embodiments, if the values match, then the controller determines sensor A and sensor B are functioning properly. If the values differ by more than a predefined tolerance, then the controller identifies one or more of sensor A or sensor B as being faulty. In some embodiments, the controller determines that sensor A and sensor B are functioning properly (e.g., not faulty) if each of the results of step 605, 607 and 609 are yes.

Figure 7:
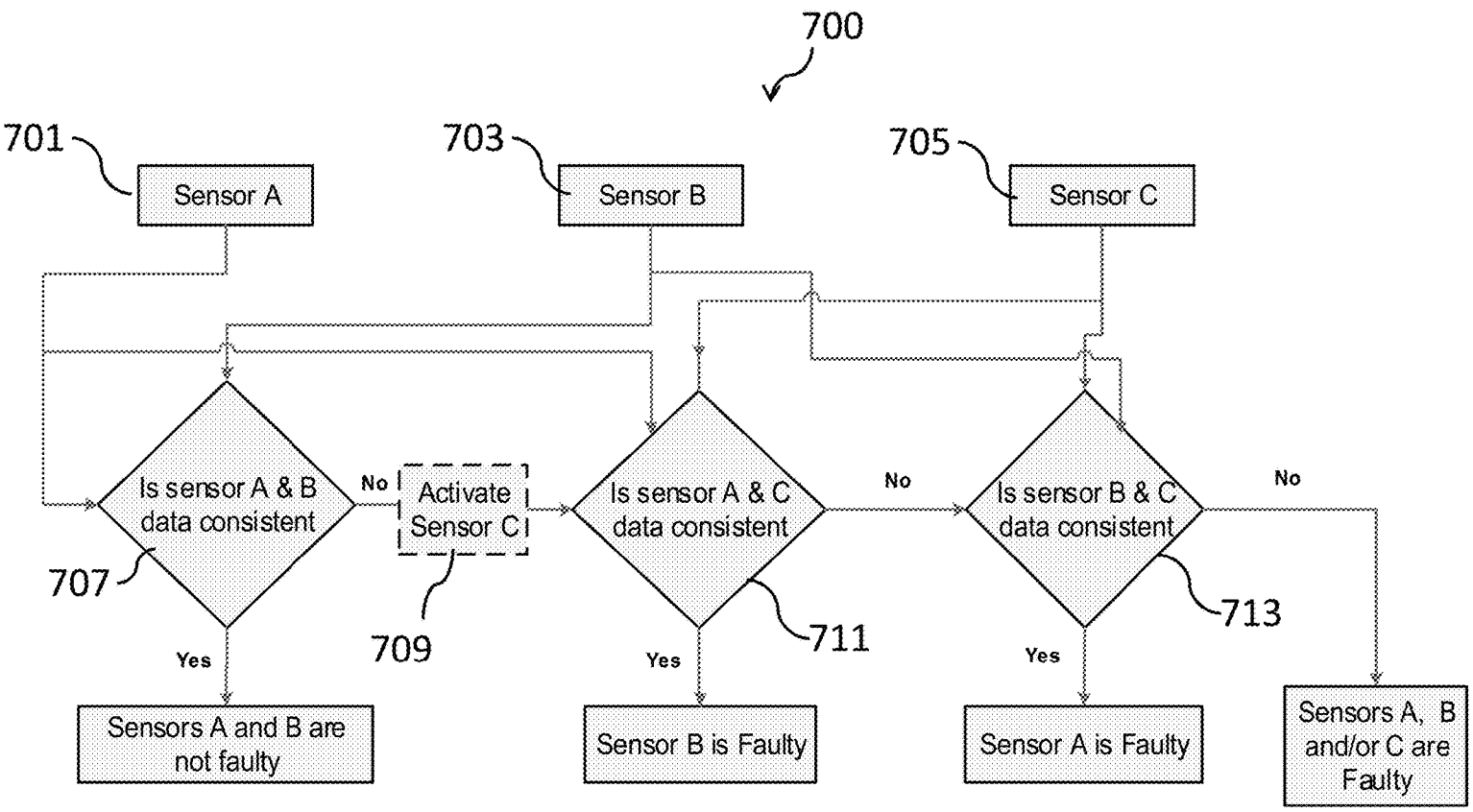
FIG. 7 is a flowchart of a method for checking consistency between the sensors on a same end of the vehicle, in accordance with one or more embodiments.

FIG. 7 is a flowchart of a method 700 for checking consistency between the sensors on a same end of the vehicle, in accordance with one or more embodiments. In some embodiments, one or more steps of method 700 is implemented by a controller such as controller 108 (FIG. 1), a set of sensors A and B, and an auxiliary sensor C. Sensors A and B are a pair of sensors on a same end of the vehicle such as, the first set of sensors 110 (FIG. 1) or the second set of sensors 112 (FIG. 1). Auxiliary sensor C is, for example, a sensor such as first auxiliary sensor 110*c* (FIG. 1) or second auxiliary sensor 112*c*.

In step 701, sensor A detects an object such as a marker 120 (FIG. 1) and generates sensor data based on the detected object. The sensor data comprises a range (e.g., distance) between sensor A and the detected object and the relative velocity of sensor A with respect to the detected object. Based on the sensor data generated by sensor A, the controller calculates the velocity of the vehicle, calculates the distance the vehicle traveled, and determines the leading end of the vehicle.

In step 703, sensor B detects the object and generates sensor data based on the detected object. The sensor data comprises a range (e.g., distance) between sensor B and the detected object and the relative velocity of sensor B with respect to the detected object. Based on the sensor data generated by sensor B, the controller calculates the velocity of the vehicle, calculates the distance the vehicle traveled, and determines the leading end of the vehicle.

In step 705, sensor C detects the object and generates sensor data based on the detected object. The sensor data comprises a range (e.g., distance) between sensor C and the detected object and the relative velocity of sensor C with respect to the detected object. Based on the sensor data generated by sensor C, the controller calculates the velocity of the vehicle, calculates the distance the vehicle traveled, and determines the leading end of the vehicle.

In step 707, the controller compares one or more of the sensor data generated by sensor A with the corresponding sensor data generated by sensor B. For example, the controller compares one or more of the velocity of the vehicle that is determined based on the sensor data generated by sensor A with the velocity of the vehicle that is determined based on the sensor data generated by sensor B, the distance the vehicle traveled that is determined based on the sensor data generated by sensor A with the distance the vehicle traveled that is determined based on the sensor data generated by sensor B, or the leading end of the vehicle that is determined based on the sensor data generated by sensor A with the leading end of the vehicle that is determined based on the sensor data generated by sensor B. If the values match, then the controller determines sensor A and sensor B are functioning properly (e.g., not faulty). If the values differ by more than a predefined tolerance, then the controller identifies one or more of sensor A or sensor B as being faulty.

In step 709, controller activates sensor C. In some embodiments, step 709 is executed prior to one or more of steps 701, 703, 705 or 707.

In step 711, the controller compares one or more of the sensor data generated by sensor A with the corresponding sensor data generated by sensor C. For example, the controller compares one or more of the velocity of the vehicle that is determined based on the sensor data generated by sensor A with the velocity of the vehicle that is determined based on the sensor data generated by sensor C, the distance the vehicle traveled that is determined based on the sensor data generated by sensor A with the distance the vehicle traveled that is determined based on the sensor data generated by sensor C, or the leading end of the vehicle that is determined based on the sensor data generated by sensor A with the leading end of the vehicle that is determined based on the sensor data generated by sensor C. If the values match, then the controller determines sensor A and sensor C are functioning properly (e.g., not faulty), and the controller identifies sensor B as being faulty. If the values differ by more than the predefined tolerance, then the controller identifies one or more of sensor A or sensor C as being faulty.

In step 713, the controller compares one or more of the sensor data generated by sensor B with the sensor data generated by sensor C. For example, the controller compares one or more of the velocity of the vehicle that is determined based on the sensor data generated by sensor B with the velocity of the vehicle that is determined based on the sensor data generated by sensor C, the distance the vehicle traveled that is determined based on the sensor data generated by sensor B with the distance the vehicle traveled that is determined based on the sensor data generated by sensor C, or the leading end of the vehicle that is determined based on the sensor data generated by sensor B with the leading end of the vehicle that is determined based on the sensor data generated by sensor C. If the values match, then the controller determines sensor B and sensor C are functioning properly (e.g., not faulty), and the controller identifies sensor A as being faulty. If the values differ by more than the predefined tolerance, then the controller identifies two or more of sensor A, sensor B or sensor C as being faulty.

Figure 8:
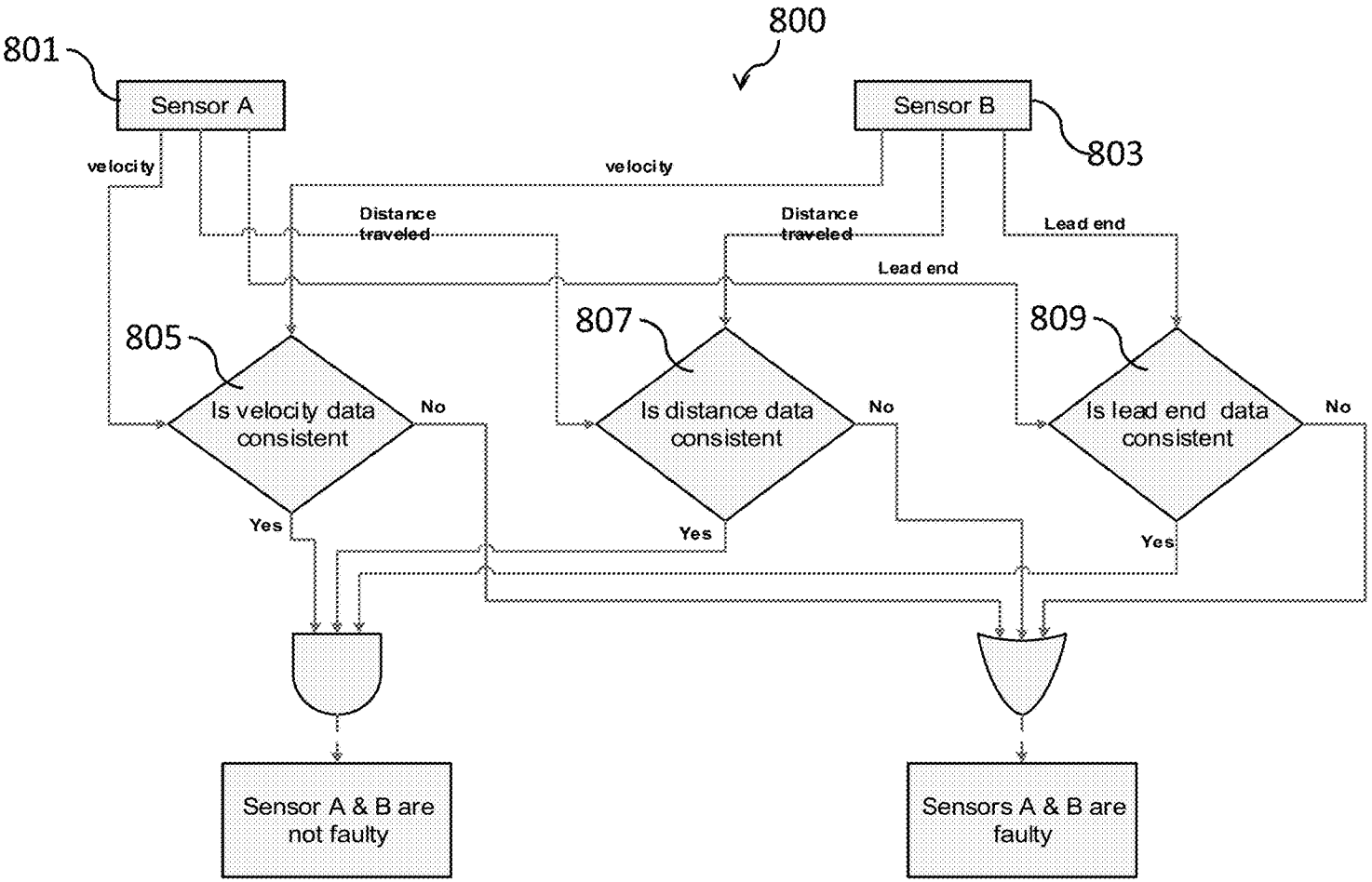
FIG. 8 is a flowchart of a method for checking consistency between the sensors on opposite ends of the vehicle, in accordance with one or more embodiments.

FIG. 8 is a flowchart of a method 800 for checking consistency between sensors on opposite ends of the vehicle, in accordance with one or more embodiments. In some embodiments, one or more steps of method 800 is implemented by a controller such as controller 108 (FIG. 1) and sensors A and B. Sensors A is, for example, a sensor such as first sensor 110*a* (FIG. 1). Sensor B is, for example, a sensor such as third sensor 112*a* (FIG. 1).

In step 801, sensor A detects an object such as a marker 120 (FIG. 1) and generates sensor data based on the detected object. The sensor data comprises a range (e.g., distance) between sensor A and the detected object and the relative velocity of sensor A with respect to the detected object. Based on the sensor data generated by sensor A, the controller calculates the velocity of the vehicle, calculates the distance the vehicle traveled, and determines the leading end of the vehicle.

In step 803, sensor B, on the opposite end of the vehicle, detects the object and generates sensor data based on the detected object. The sensor data comprises a range (e.g., distance) between sensor B and the detected object and the relative velocity of sensor B with respect to the detected object. Based on the sensor data generated by sensor B, the controller calculates the velocity of the vehicle, calculates the distance the vehicle traveled, and determines the leading end of the vehicle.

In step 805, the controller compares the velocity of the vehicle that is determined based on the sensor data generated by sensor A with the velocity of the vehicle that is determined based on the sensor data generated by sensor B. In some embodiments, if the magnitudes match, then the controller determines sensor A and sensor B are functioning properly (e.g., not faulty). If the magnitudes differ by more than a predefined tolerance, then the controller identifies one or more of sensor A or sensor B as being faulty. The controller is configured to compare the magnitudes of the velocities determined based on the sensor data generated by sensor A and sensor B because the sensor on the leading end of the vehicle will generate sensor data that results in a negative velocity as the vehicle approaches the detected marker, and the sensor on the non-leading end of the vehicle will generate sensor data that results in a positive velocity as the vehicle departs from the detected marker. In some embodiments, if the velocity values match within the predefined threshold, then the controller is configured to use an average of the velocity values as the velocity of the vehicle.

In step 807, the controller compares the distance the vehicle traveled that is determined based on the sensor data generated by sensor A with the distance the vehicle traveled that is determined based on the sensor data generated by sensor B. In some embodiments, if the values match, then the controller determines sensor A and sensor B are functioning properly (e.g., not faulty). If the values differ by more than a predefined tolerance, then the controller identifies one or more of sensor A or sensor B as being faulty. In some embodiments, if the distance the vehicle traveled values match within the predefined threshold, then the controller is configured to use an average of the distance traveled values as the distance the vehicle traveled.

In step 809, the controller compares the leading end of the vehicle that is determined based on the sensor data generated by sensor A with the leading end of the vehicle that is determined based on the sensor data generated by sensor B. In some embodiments, if the values match, then the controller determines sensor A and sensor B are functioning properly (e.g., not faulty). If the values differ by more than a predefined tolerance, then the controller identifies one or more of sensor A or sensor B as being faulty. In some embodiments, the controller determines that sensor A and sensor B are functioning properly (e.g., not faulty) if each of the results of step 805, 807 and 809 are yes.

Figure 9:
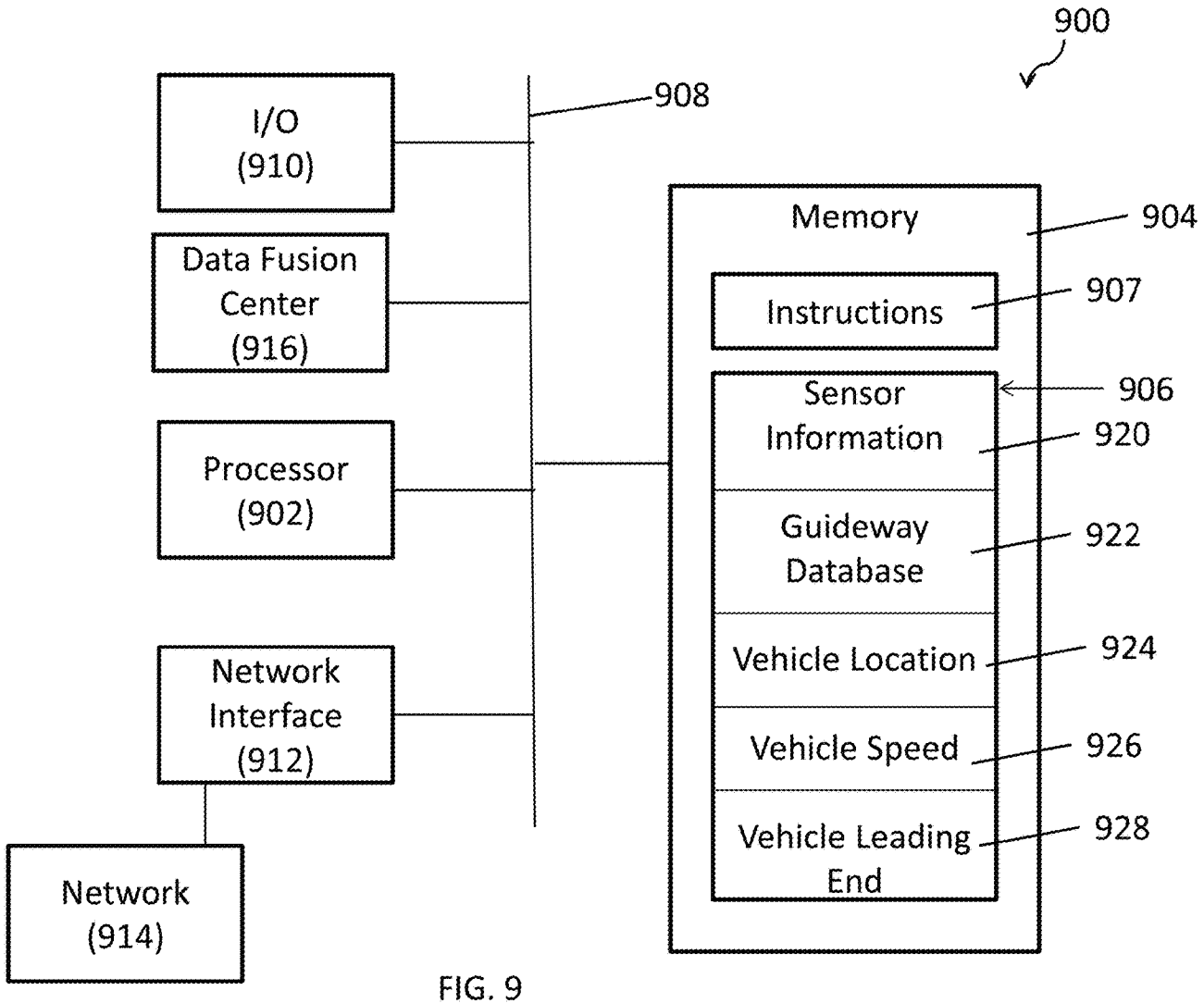
FIG. 9 is a block diagram of a vehicle on board controller ("VOBC"), in accordance with one or more embodiments.

FIG. 9 is a block diagram of a vehicle on board controller ("VOBC") 500, in accordance with one or more embodiments. VOBC 500 is usable in place of one or more of controller 108 (FIG. 1) or data fusion center 230 (FIG. 2), alone or in combination with memory 109 (FIG. 1). VOBC 900 includes a specific-purpose hardware processor 902 and a non-transitory, computer readable storage medium 904 encoded with, i.e., storing, the computer program code 906, i.e., a set of executable instructions. Computer readable storage medium 904 is also encoded with instructions 907 for interfacing with manufacturing machines for producing the memory array. The processor 902 is electrically coupled to the computer readable storage medium 904 via a bus 908. The processor 902 is also electrically coupled to an I/O interface 910 by bus 908. A network interface 912 is also electrically connected to the processor 902 via bus 908. Network interface 912 is connected to a network 914, so that processor 902 and computer readable storage medium 904 are capable of connecting to external elements via network 914. VOBC 900 further includes data fusion center 916. The processor 902 is connected to data fusion center 916 via bus 908. The processor 902 is configured to execute the computer program code 906 encoded in the computer readable storage medium 904 in order to cause system 900 to be usable for performing a portion or all of the operations as described in method 500, 600, 700, or 800.

In some embodiments, the processor 902 is a central processing unit (CPU), a multi-processor, a distributed processing system, an application specific integrated circuit (ASIC), and/or a suitable processing unit.

In some embodiments, the computer readable storage medium 904 is an electronic, magnetic, optical, electromagnetic, infrared, and/or a semiconductor system (or apparatus or device). For example, the computer readable storage medium 904 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 904 includes a compact disk-read only memory (CD-ROM), a compact disk-read/write (CD-R/W), and/or a digital video disc (DVD).

In some embodiments, the storage medium 904 stores the computer program code 906 configured to cause system 900 to perform method 500, 600, 700 or 800. In some embodiments, the storage medium 904 also stores information needed for performing method 500, 600, 700 or 800 as well as information generated during performing the method 500, 600, 700 or 800 such as a sensor information parameter 920, a guideway database parameter 922, a vehicle location parameter 924, a vehicle speed parameter 926, a vehicle leading end parameter 928, and/or a set of executable instructions to perform the operation of method 500, 600, 700 or 800.

In some embodiments, the storage medium 904 stores instructions 907 to effectively implement method 500, 600, 700 or 800.

VOBC 900 includes I/O interface 910. I/O interface 910 is coupled to external circuitry. In some embodiments, I/O interface 910 includes a keyboard, keypad, mouse, trackball, trackpad, and/or cursor direction keys for communicating information and commands to processor 902.

VOBC 900 also includes network interface 912 coupled to the processor 902. Network interface 912 allows VOBC 900 to communicate with network 914, to which one or more other computer systems are connected. Network interface 912 includes wireless network interfaces such as BLUETOOTH, WIFI, WIMAX, GPRS, or WCDMA; or wired network interface such as ETHERNET, USB, or IEEE-1394. In some embodiments, method 500, 600, 700 or 800 is implemented in two or more VOBCs 900, and information such as memory type, memory array layout, I/O voltage, I/O pin location and charge pump are exchanged between different VOBCs 900 via network 914.

VOBC further includes data fusion center 916. Data fusion center 916 is similar to data fusion center 230 (FIG. 2). In the embodiment of VOBC 900, data fusion center 916 is integrated with VOBC 900. In some embodiments, the data fusion center is separate from VOBC 900 and connects to the VOBC 900 through I/O interface 910 or network interface 912.

VOBC 900 is configured to receive sensor information related to a fusion sensor arrangement, e.g., fusion sensor arrangement 200 (FIG. 2), through data fusion center 916. The information is stored in computer readable medium 904 as sensor information parameter 920. VOBC 900 is configured to receive information related to the guideway database through I/O interface 910 or network interface 912. The information is stored in computer readable medium 904 as guideway database parameter 922. VOBC 900 is configured to receive information related to vehicle location through I/O interface 910, network interface 912 or data fusion center 916. The information is stored in computer readable medium 904 as vehicle location parameter 924. VOBC 900 is configured to receive information related to vehicle speed through I/O interface 910, network interface 912 or data fusion center 916. The information is stored in computer readable medium 904 as vehicle speed parameter 926.

During operation, processor 902 executes a set of instructions to determine the location and speed of the guideway mounted vehicle, which are used to update vehicle location parameter 924 and vehicle speed parameter 926. Processor 902 is further configured to receive LMA instructions and speed instructions from a centralized or de-centralized control system. Processor 902 determines whether the received instructions are in conflict with the sensor information. Processor 902 is configured to generate instructions for controlling an acceleration and braking system of the guideway mounted vehicle to control travel along the guideway.

An aspect of this description relates to a system comprising a set of sensors on a first end of a vehicle having the first end and a second end, and a controller coupled with the set of sensors. The sensors of the set of sensors are each configured to generate corresponding sensor data based on a detected marker of a plurality of markers along a direction of movement of the vehicle. A first sensor of the set of sensors has a first inclination angle with respect to the detected marker of the plurality of markers, and a second sensor of the set of sensors has a second inclination angle with respect to the detected marker of the plurality of markers different from the first inclination angle. The controller is configured to compare a time the first sensor detected the marker of the plurality of markers with a time the second sensor detected the marker of the plurality of markers. The controller is also configured to identify the first end or the second end as a leading end of the vehicle based on the comparison of the time the first sensor detected the marker of the plurality of markers with the time the second sensor detected the marker of the plurality of markers. The controller is further configured to calculate a position of the leading end of the vehicle based on the sensor data generated by one or more of the first sensor or the second sensor.

Another aspect of this description relates to a method comprising generating sensor data based on a detection of a marker of a plurality markers along a direction of movement of a vehicle having a first end and a second end using a set of sensors on the first end of the vehicle. Each sensor of the set of sensors on the first end of the vehicle is configured to generate corresponding sensor data. A first sensor of the set of sensors has a first inclination angle with respect to the detected marker of the plurality of markers, and a second sensor of the set of sensors has a second inclination angle with respect to the detected marker of the plurality of markers different from the first inclination angle. The method also comprises comparing a time the first sensor detected the marker of the plurality of markers with a time the second sensor detected the marker of the plurality of markers. The method further comprises identifying the first end or the second end as a leading end of the vehicle based on the comparison of the time the first sensor detected the marker of the plurality of markers with the time the second sensor detected the marker of the plurality of markers. The method additionally comprises calculating a position of the leading end of the vehicle based on the sensor data generated by one or more of the first sensor or the second sensor.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A system, comprising:

a set of sensors on a first end of a vehicle having the first end and a second end, the sensors of the set of sensors each being configured to generate corresponding sensor data based on a detected marker of a plurality of markers along a direction of movement of the vehicle, a first sensor of the set of sensors has a first inclination angle with respect to a horizon line, and a second sensor of the set of sensors has a second inclination angle with respect to the horizon line; and a controller coupled with the set of sensors, the controller being configured to:

compare a time at which the first sensor detected the marker of the plurality of markers with a time at which the second sensor detected the marker of the plurality of markers; and calculate a position of the first end of the vehicle based on a distance between a first marker of the plurality of markers and the detected marker of the plurality of markers.

2. The system of claim 1, wherein the controller is further configured to:

identify the first end or the second end as a leading end of the vehicle based on the comparison of the time the first sensor detected the marker of the plurality of markers with the time the second sensor detected the marker of the plurality of markers; and calculate a position of the leading end of the vehicle based on the sensor data generated by one or more of the first sensor or the second sensor.

3. The system of claim 1, wherein the first inclination angle is different from the second inclination angle.

4. The system of claim 1, wherein markers of the plurality of markers are pairs of markers separated by a distance stored in a memory, and the controller is further configured to:

count a quantity of markers of the plurality of markers detected by the set of sensors during a predetermined duration of time;

search the memory for the stored distance between each pair of markers of the plurality of markers detected by the set of sensors during the predetermined duration of time; and add the distances between each pair of markers of the plurality of markers for the quantity of markers detected by the set of sensors to determine a distance the vehicle traveled during the predetermined duration of time.

5. The system of claim 4, wherein the controller is further configured to calculate a velocity of the vehicle based on the distance the vehicle traveled and the predetermined duration of time.

6. The system of claim 4, wherein the markers of the plurality of markers are consecutive markers.

7. The system of claim 1, wherein one or more markers of the plurality of markers comprise a pattern of objects, and the sensors of the set of sensors are configured to recognize the one or more markers based on the pattern of objects.

8. The system of claim 1, wherein a field of view of the first marker is based on the first inclination angle, a field of view of the second marker is based on the second inclination angle, and the markers of the plurality of markers are spaced along the direction of movement of the vehicle such that the detected marker of the plurality of markers is limited to being within one of the field of view of the first marker or the field of view of the second marker.

9. The system of claim 1, wherein the vehicle is configured to move along a guideway, and one or more markers of the plurality of markers is on or adjacent to a wayside of the guideway.

10. The system of claim 1, wherein the set of sensors further comprises a third sensor, and the controller is further configured to compare a first calculated value based on the sensor data generated by the first sensor with a second calculated value based on the sensor data generated by the second sensor;

identify one of the first sensor or the second sensor as being faulty based on a determination that the first calculated value differs from the second calculated value by more than a predefined threshold;

activate the third sensor;

compare a third calculated value based on the sensor data generated by the third sensor with the first calculated value and with the second calculated value; and identify which of the first sensor or the second sensor is faulty based on a determination that the first calculated value matches the third calculated value within the predefined threshold, or the second calculated value matches the third calculated value within the predefined threshold.

11. The system of claim 10, wherein each of the first calculated value and the second calculated value is the identification of leading end of the vehicle, the position of the leading end of the vehicle, a distance the vehicle traveled, or a velocity of the vehicle.

12. The system of claim 1, further comprising:

a set of sensors on the second end of the vehicle, the sensors of the set of sensors on the second end of the vehicle each being configured to generate corresponding sensor data based on the detected marker of the plurality of markers, a third sensor of the set of sensors on the second end of the vehicle has a third inclination angle with respect to the horizon line, and a fourth sensor of the set of sensors on the second end of the vehicle has a fourth inclination angle with respect to the horizon line, wherein the controller is further configured to compare a time the third sensor detected the marker of the plurality of markers with a time the fourth sensor detected the marker of the plurality of markers; and calculate a position of the first end of the vehicle based on a distance between a first marker of the plurality of markers and the detected marker of the plurality of markers.

13. The system of claim 12, wherein the controller is further configured to:

compare a first calculated value based on the sensor data generated by one or more of the first sensor or the second sensor with a second calculated value based on the sensor data generated by one or more of the third sensor or the fourth sensor; and identify one of the first sensor, the second sensor, the third sensor, or the fourth sensor as being faulty based on a determination that the first calculated value differs from the second calculated value by more than a predefined threshold.

14. The system of claim 13, wherein each of the first calculated value and the second calculated value is the identification of the leading end of the vehicle, the position of the leading end of the vehicle, a distance the vehicle traveled, or a velocity of the vehicle.

15. The system of claim 12, wherein the controller is further configured to:

identify the first end or the second end as the leading end of the vehicle based on the comparison of the time the third sensor detected the marker of the plurality of markers with the time the fourth sensor detected the marker of the plurality of markers; and calculate the position of the leading end of the vehicle based on the sensor data generated by one or more of the third sensor or the fourth sensor.

16. The system of claim 15, wherein the controller is further configured to calculate a first velocity of the leading end of the vehicle based on the sensor data generated by the set of sensors on the end of the vehicle identified as being the leading end of the vehicle;

calculate a second velocity of the other of the first end or the second end that is other than the leading end of the vehicle based on the sensor data generated by the set of sensors on the end of the vehicle that is other than the leading end of the vehicle; and generate an alarm based on a determination that a magnitude of the first velocity differs from a magnitude of the second velocity by more than a predefined threshold.

17. A method, comprising:

generating sensor data based on a detection of a marker of a plurality of markers along a direction of movement of a vehicle having a first end and a second end using a set of sensors on the first end of the vehicle, wherein each sensor of the set of sensors on the first end of the vehicle is configured to generate corresponding sensor data, a first sensor of the set of sensors has a first inclination angle with respect to a horizon line, and a second sensor of the set of sensors has a second inclination angle with respect to the horizon line;

comparing a time the first sensor detected the marker of the plurality of markers with a time the second sensor detected the marker of the plurality of markers;

count a quantity of markers of the plurality of markers detected by the set of sensors during a predetermined duration of time;

search a memory for the stored distance between each pair of markers of the plurality of markers detected by the set of sensors during the predetermined duration of time, the memory having stored therein a distance separating pairs of markers of the plurality of markers; and add the distances between each pair of markers of the plurality of markers for the quantity of markers detected by the set of sensors to determine a distance the vehicle traveled during the predetermined duration of time, wherein the distances between each pair of markers of the plurality of markers is determined based on:

searching a memory for the stored distance between each pair of markers of the plurality of markers detected by the set of sensors during the predetermined duration of time, the memory having stored therein a distance separating pairs of markers of the plurality of markers; or counting a quantity of markers of the plurality of markers detected by the set of sensors on the first end of the vehicle within a predetermined duration of time and calculating a distance the vehicle traveled during the predetermined duration of time based on a total quantity of the detected markers and an equal distance between each of the markers of the plurality of markers.

18. The method of claim 17, further comprising:

identifying the first end or the second end as a leading end of the vehicle based on the comparison of the time the first sensor detected the marker of the plurality of markers with the time the second sensor detected the marker of the plurality of markers; and calculating a position of the leading end of the vehicle based on the sensor data generated by one or more of the first sensor or the second sensor.

19. The method of claim 17, further comprising:

detecting a pattern of objects on a guideway along which the vehicle moves; and recognizing the pattern of objects as the detected marker of the plurality of markers based on data stored in a memory comprising information describing the detected marker of the plurality of markers.

20. The method of claim 17, further comprising:

calculating a position of the end of the vehicle that is other than the leading end of the vehicle based on the position of the leading end of the vehicle and a length of the vehicle.

21. The method of claim 17, further comprising:

generating sensor data based on a detection of the marker of the plurality markers using a set of sensors on the second end of the vehicle, wherein each sensor of the set of sensors on the second end of the vehicle is configured to generate corresponding sensor data, a third sensor of the set of sensors on the second end of the vehicle has a third inclination angle with respect to the detected marker of the plurality of markers, and a fourth sensor of the set of sensors on the second end of the vehicle has a second inclination angle with respect to the detected marker of the plurality of markers different from the third inclination angle;

comparing a time the third sensor detected the marker of the plurality of markers with a time the fourth sensor detected the marker of the plurality of markers;

identifying the first end or the second end as the leading end of the vehicle based on the comparison of the time the third sensor detected the marker of the plurality of markers with the time the fourth sensor detected the marker of the plurality of markers;

calculating the position of the leading end of the vehicle based on the sensor data generated by one or more of the third sensor or the fourth sensor; and generating an alarm if the position of the leading end of the vehicle calculated based on the sensor data generated by one of more of the first sensor or the second sensor differs from the position of the leading end of the vehicle calculated based on the sensor data generated by one or more of the third sensor or the fourth sensor by more than a predefined threshold.

22. The method of claim 17, wherein the markers of the plurality of markers are consecutive markers.

* * * * *